US008398499B2

(12) United States Patent
Voden

(10) Patent No.: US 8,398,499 B2
(45) **Date of Patent: *Mar. 19, 2013**

(54) ROTARY GAME TABLE

(75) Inventor: Justin L. Voden, Muskego, WI (US)

(73) Assignee: Triumph Sports USA, Inc., West Allis, WI (US)

( * ) Notice: Subject to any disclaimer, the term of this patent is extended or adjusted under 35 U.S.C. 154(b) by 1 day.

This patent is subject to a terminal disclaimer.

(21) Appl. No.: 13/158,751

(22) Filed: Jun. 13, 2011

(65) Prior Publication Data

US 2011/0237338 A1 Sep. 29, 2011

Related U.S. Application Data

(63) Continuation of application No. 10/884,764, filed on Jul. 2, 2004, now Pat. No. 7,967,693, which is a continuation-in-part of application No. 10/768,512, filed on Jan. 29, 2004, now Pat. No. 7,972,219.

(51) Int. Cl.
*A63D 15/04* (2006.01)
*A63D 15/00* (2006.01)

(52) U.S. Cl. ..... 473/10; 473/14; 473/16; 473/1

(58) Field of Classification Search ..... 473/1, 4, 473/6, 9, 10, 14–16, 19; 273/108.1, 309; 108/1, 11, 12, 19, 94; D21/318, 385, 397
See application file for complete search history.

(56) References Cited

U.S. PATENT DOCUMENTS

| | | | | |
|---|---|---|---|---|
| 122,830 | A | 1/1872 | Heyl | |
| 211,083 | A | 1/1879 | Bensinger | |
| 493,479 | A | 3/1893 | Carl et al. | |
| 493,749 | A * | 3/1893 | Born et al. | 261/17 |
| 510,232 | A * | 12/1893 | Bassett | 108/127 |
| 572,688 | A * | 12/1896 | Seifert | 473/14 |
| 715,055 | A * | 12/1902 | Greenlaw et al. | 312/228 |
| 747,726 | A | 12/1903 | Karhan | |
| 1,345,194 | A | 6/1920 | Johnson | |
| 1,353,728 | A | 9/1920 | Dence | |
| 1,862,010 | A * | 6/1932 | Ehrlich | 294/144 |
| 1,900,513 | A | 3/1933 | Marsh | |
| 2,008,613 | A * | 7/1935 | Hernes | 108/90 |
| 2,115,115 | A * | 4/1938 | Matteson et al. | 473/14 |
| 2,174,613 | A * | 10/1939 | Blaschke | 221/199 |
| 2,248,276 | A | 7/1941 | Le Tourneau | |
| 2,473,022 | A * | 6/1949 | Fenske, Jr. | 190/12 R |

(Continued)

FOREIGN PATENT DOCUMENTS

| | | |
|---|---|---|
| CA | 744276 | 10/1966 |
| EP | 0238471 | 9/1987 |

OTHER PUBLICATIONS

Fairminded Industries Inc—DF-BT236 Pool and Air Hockey Game Table in One; www.globalsources.com, 2005.

*Primary Examiner* — Mitra Aryanpour
(74) *Attorney, Agent, or Firm* — Michael Best & Friedrich LLP

(57) ABSTRACT

A rotary game table includes a combination game table, two side support members, and at least one cross member. The combination game table includes one type of game on one side and another type of game on the other side. The at least one cross member is terminated on each end by a single side support member. The combination game table is pivotally retained by one side support member on each end thereof. A locking device is used to pivotally constrain rotation of the combination game table. At least one table cross member is used to internally brace the combination game table with at least one air passage formed therethrough. In another embodiment, a substantially U-shaped side member is attached to one cross member and one end of the two side support members. In another embodiment, a collapsible support is used to increase rigidity of the side support members.

20 Claims, 24 Drawing Sheets

U.S. PATENT DOCUMENTS 2,693,225 A * 11/1954 Hinckley ..... 108/12
3,227,105 A 1/1966 Reisdorff et al.
3,688,705 A * 9/1972 Barabas ..... 108/17
3,722,888 A 3/1973 Ducharme
3,770,334 A 11/1973 Weber
3,815,078 A 6/1974 Fedrick
3,815,917 A 6/1974 Brown
3,866,913 A 2/1975 Zimmers et al.
D247,127 S * 1/1978 Kavka ..... D21/318
4,305,581 A 12/1981 Neuharth
4,345,758 A * 8/1982 Kempf ..... 473/475
4,480,833 A * 11/1984 Barcelow et al. ..... 273/108.56
4,520,239 A 5/1985 Schwartz
4,552,362 A 11/1985 Oake
4,722,530 A 2/1988 Hendon
4,838,179 A 6/1989 Bing
4,863,170 A 9/1989 Tonokura
4,927,140 A 5/1990 Pappas
5,083,241 A 1/1992 Foster
5,329,979 A 7/1994 Miller et al.
5,573,239 A 11/1996 Ryker et al.
5,630,760 A * 5/1997 Brown et al. ..... 273/108.52
D397,727 S * 9/1998 Tilly ..... D21/312
5,829,501 A 11/1998 DeVito
5,941,778 A 8/1999 Vasalech
6,003,866 A * 12/1999 Tsai ..... 273/126 A
6,007,438 A 12/1999 Harrell
6,053,587 A 4/2000 Boerder
6,095,156 A 8/2000 Smith, II
6,105,960 A * 8/2000 Carames ..... 273/108.1
6,109,607 A * 8/2000 Cartwright et al. ..... 273/108.1
6,155,564 A 12/2000 Tsai
6,170,775 B1 1/2001 Kovacik et al.
6,237,659 B1 5/2001 Francis
6,273,354 B1 8/2001 Kovacik et al.
6,347,797 B1 2/2002 Tsai
6,349,939 B1 * 2/2002 Tsai ..... 273/108.1
6,419,224 B1 7/2002 Tsai
6,439,360 B1 8/2002 Miller
6,452,180 B1 9/2002 Nistler et al.
6,502,819 B2 * 1/2003 Rieber et al. ..... 273/126 R
6,616,141 B2 * 9/2003 Diamant ..... 273/108.1
6,659,879 B1 12/2003 Cartwright
6,712,711 B1 3/2004 Skelton et al.
6,764,409 B1 7/2004 Voden
6,845,575 B1 1/2005 Hwang
6,848,937 B1 2/2005 Hsiao
6,854,575 B1 2/2005 Desormeaux et al.
7,762,902 B2 7/2010 Voden
7,785,208 B2 8/2010 Voden
7,967,693 B1 6/2011 Voden
7,967,694 B2 6/2011 Voden
D653,710 S * 2/2012 Davis et al. ..... D21/318
2004/0067796 A1 4/2004 Murrey et al.
2004/0132537 A1 7/2004 Voden
2005/0049056 A1 3/2005 Padilla
2005/0064945 A1 3/2005 Voden
2005/0104294 A1 5/2005 Chen

* cited by examiner

ROTARY GAME TABLE

CROSS-REFERENCES TO RELATED APPLICATIONS

This application is a continuation application of U. S. patent application Ser. No. 10/884,764 filed Jul. 2, 2004, which is a continuation-in-part of U. S. patent application Ser. No. 10/768,512 filed Jan. 29, 2004. The entire content of both applications are herein incorporated by reference.

FIELD OF THE INVENTION

The present invention relates generally to game tables and more specifically to a rotary game table, which provides a full size pool table, an air powered hockey surface, a gaming table, table soccer game, or a ping-pong surface by rotation of a combination game table.

DISCUSSION OF THE PRIOR ART

It appears that the prior art does not disclose a combination full size pool table and air powered hockey table in one rotatable structure. U.S. Pat. No. 4,305,581 to Neuharth discloses a pivotable playing table. A billiard table is pivotally supported by two pedestals in either a horizontal or vertical orientation. U.S. Pat. No. 6,155,564 to Tsai discloses an air system structure of rotary game table. A double sided game surface is pivotally retained in a game table base. The double sided game surface includes table soccer on one surface and an air powered hockey table on the opposite surface. U.S. Pat. No. 6,347,797 discloses a game table with using modes convertible by way of rotation. A table body is pivotally retained in a table frame. The table body includes table soccer on one surface and a pool table on the opposite surface.

Accordingly, there is a clearly felt need in the art for a rotary game table, which provides a full size pool table, an air powered hockey surface, a gaming table, a table soccer game, or a ping-pong surface by rotation of a combination game table and manipulation of a securing device.

SUMMARY OF THE INVENTION

The present invention provides a rotary game that is rotated to provide two of the following, a full size pool table, an air powered hockey table, a gaming table or table soccer. A rotary game table includes a combination game table two side support members and at least one cross member. The combination game table includes a full size pool table surface formed on one side of the combination game table and an air powered hockey table surface formed on the opposite side. The size of the pool table surface is the same as a regulation size pool table. A plurality of pool ball pockets are formed in the pool table surface that are sized to receive normal sized pool balls. A net is preferably used to capture a billiard ball that falls into one of the pool ball pockets. However, other devices may be used to capture a billiard ball that falls into a pool ball pocket, such as a plastic molded pocket.

The air powered hockey table surface includes a plurality of air holes formed through the table surface. A diffuser plate is disposed below the air powered hockey table surface. An air blower is preferably retained in a sliding drawer between the pool table surface and the diffuser plate. An air hole is formed through the diffuser plate to receive an output of the air blower. The air blower draws air from inside the combination game table and pushes the air through the plurality of air holes. A puck slot is disposed on each end of the air powered hockey table to provide scoring in a game of air powered hockey.

Preferably, at least one accessory retainer is terminated on each end with a single side support member. The at least one cross member is also terminated on each end by a single side support member. The combination game table is pivotally retained by a single side support member on each end thereof. At least one locking pin device is disposed in each side support member. Each locking pin device is preferably spring loaded such that a spring pin is in a normally extended position. At least one pin cavity is formed in each end of the combination game table to receive the at least one locking pin. The at least one locking pin is withdrawn from the at least one pin cavity to allow the game table to be rotated. A separate locking pin may also be used that is withdrawn from each side support member.

A second embodiment of a rotary game table includes a combination game table, two side support members, at least two pivotal support arms and at least one cross member. The combination game table is the same as in the first embodiment. Preferably, at least one accessory retainer acts as the at least one cross member. The at least one accessory retainer is terminated on each end with a single side support member. The combination game table is pivotally retained by one side support member on each end thereof. Each pivotal support arm is pivotally attached to one end of one side support member. The pivotal support arms are swung such that they are parallel with the side support members when rotating the combination game table. Each pivotal support arm is attachable to a single accessory retainer with any suitable quick release fastener. The at least one locking pin device may also be disposed in each side support member.

A third embodiment of a rotary game table includes a combination game table, two side support members, and at least one cross member. The combination game table is the same as in the first embodiment. The at least one cross member is terminated on each end with a single side support member. The combination game table is pivotally retained by one side support member on each end thereof. At least one locking pin device is disposed in each side support member.

A pivotal support arm may be substituted for the at least one locking pin device. Each pivotal support arm would be pivotally attached to one end of one side support member. The pivotal support arms are swung such that they are parallel with the side support members when rotating the combination game table. Each pivotal support arm is attachable to a single cross member with any suitable quick release fastener.

At least one of the two side support members is preferably configured to retain game accessories such as a plurality of billiard balls, cue sticks, a rack, a puck, and two hockey paddles. A plurality of game accessories is defined by at least two billiard balls.

A fourth embodiment of a rotary game table includes a combination game table, two side support members, and at least one cross member. The combination game table is the same as in the first embodiment. The at least one cross member is terminated on each end with a single side support member. The combination game table is pivotally retained by one side support member on each end thereof. Preferably, two support latches are in each side support member. One of the two side support members is preferably configured to retain game pool accessories such as a plurality of billiard balls, a rack and a brush, and the other one of the two side support member is preferably configured to retain hockey accessories such as two paddles and a puck.

A gaming table surface may be substituted for the air hockey table surface. The gaming table surface includes a gaming pocket formed in the combination game table and at least one gaming insert. The gaming insert is preferably retained with a plurality of lock clips. A dealer chip holder and player chip holders are also formed adjacent the gaming table surface.

A table soccer game may be substituted for the air hockey table surface. The table soccer game is preferably regulation size. The table soccer game includes a game cavity, a plurality of moveable rods and two rod retainers. The game cavity is formed below the surface of the combination game table. A first rod flange and a second rod flange form the side boundaries of the game cavity. The plurality of moveable rods are pivotally and slidably retained by the first and second rod flanges. A first rod retainer is pivotally attached to one side rail of the combination game table, adjacent the first rod flange and a second rod retainer is pivotally attached to an opposite side of the combination game table, adjacent the second rod flange. The first and second rod retainers reduce the amount of sliding of the plurality of moveable rods, when the combination game table is revolved.

A ping-pong surface may be formed on one side of a combination game table and a pool table surface, an air powered hockey surface, a gaming table or a table soccer game formed on the other side. A pair of net retainers are attached to the opposing sides of the combination game table at a middle thereof.

A fifth embodiment of a rotary game table includes a combination game table, two side support members, two cross members and two substantially U-shaped side members. The combination game table includes one of the pool table surface, air powered hockey surface, game table, table soccer game and ping-pong surface on one side and one other of the above on the other side. Each cross member preferably has an "L" shaped cross section. One end of each cross member is attached to one of the two side support members and the other end of each cross member is attached to the other one of the two side support members. A first substantially U-shaped side member is attached to a first end of each side support member and a length of a first cross member. A second substantially U-shaped side cover member is attached to a second end of each side support member and a length of a second cross member. The combination game table is pivotally retained by the two side support members and rotatably secured by any of the previously disclosed retention devices. The side support members may be configured to retain appropriate accessories.

A sixth embodiment of a rotary game table includes a combination game table, two side support members, two cross members and at least two collapsible supports. The combination game table includes one of the pool table surface, air powered hockey surface, game table, table soccer game and ping-pong surface on one side and one other of the above on the other side. One end of each cross member is attached to one of the two side support members and the other end of each cross member is attached to the other one of the two side support members. A pair of support latches are retained in at least one of the two side support members. The combination game table is pivotally retained by the two side support members and rotatably secured by the pair of support latches. A single slide bar is slidably retained within one of the two side support members, adjacent each support latch. One end of a pusher link is pivotally retained on an end of the support link of the support latch and the other end is pivotally retained on the slide bar. One end of a collapsible support is pivotally attached to the slide bar and the other end is pivotally attached to the cross member. The collapsible support locks in place, when the support latch is locked. The at least two collapsible supports increase the rigidity of the sixth embodiment of the rotary game table. The side support members may be configured to retain appropriate accessories.

A method for improving the rigidity of the side support member to cross member connection includes preferably at least eight threaded fasteners and at least eight traversely tapped cylinders. At least two cylinder holes are formed through the side of a single cross member at an end thereof. Each hole is sized to receive a single traversely tapped cylinder. Each traversely tapped cylinder includes a traversely tapped hole. At least two fastener holes are formed through a side of a single side support member at one end thereof. Each cross member is preferably tubular. The end of the cross member is retained against the side support member by tightening the at least two threaded fasteners in the traversely tapped holes.

Accordingly, it is an object of the present invention to provide a rotary game table, which provides a pool (billiards) table; and an air powered hockey table, a gaming table or table soccer on a combination game table.

These and additional objects, advantages, features and benefits of the present invention will become apparent from the following specification.

FIG. **4*a*** is a cross sectional view of an electrical cord of an air blower routed through a pivot pin of a rotary game table in accordance with the present invention.

FIG. **4*b*** is a cross sectional view of a male plug formed in an end or lengthwise frame member for receiving a female electrical plug to power an air blower of a rotary game table in accordance with the present invention.

FIG. **4*c*** is a perspective view of a combination game table with a pool table surface removed to reveal two table cross members with air passage openings formed therethrough of a rotary game table in accordance with the present invention.

Figure 5:
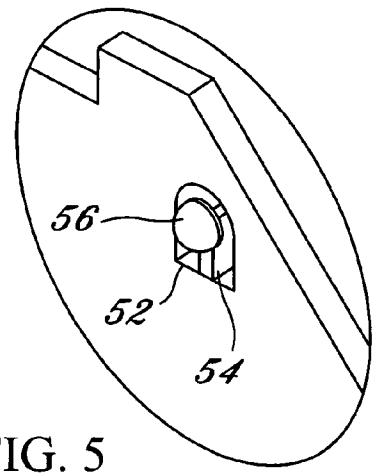

FIG. 5 is an enlarged perspective view of a locking pin device of a rotary game table in accordance with the present invention.

Figure 6:
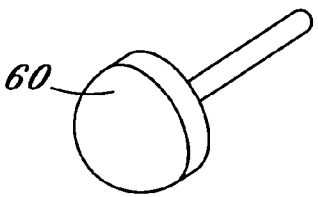

FIG. 6 is an enlarged perspective view of a locking pin of a rotary game table in accordance with the present invention.

Figure 7:
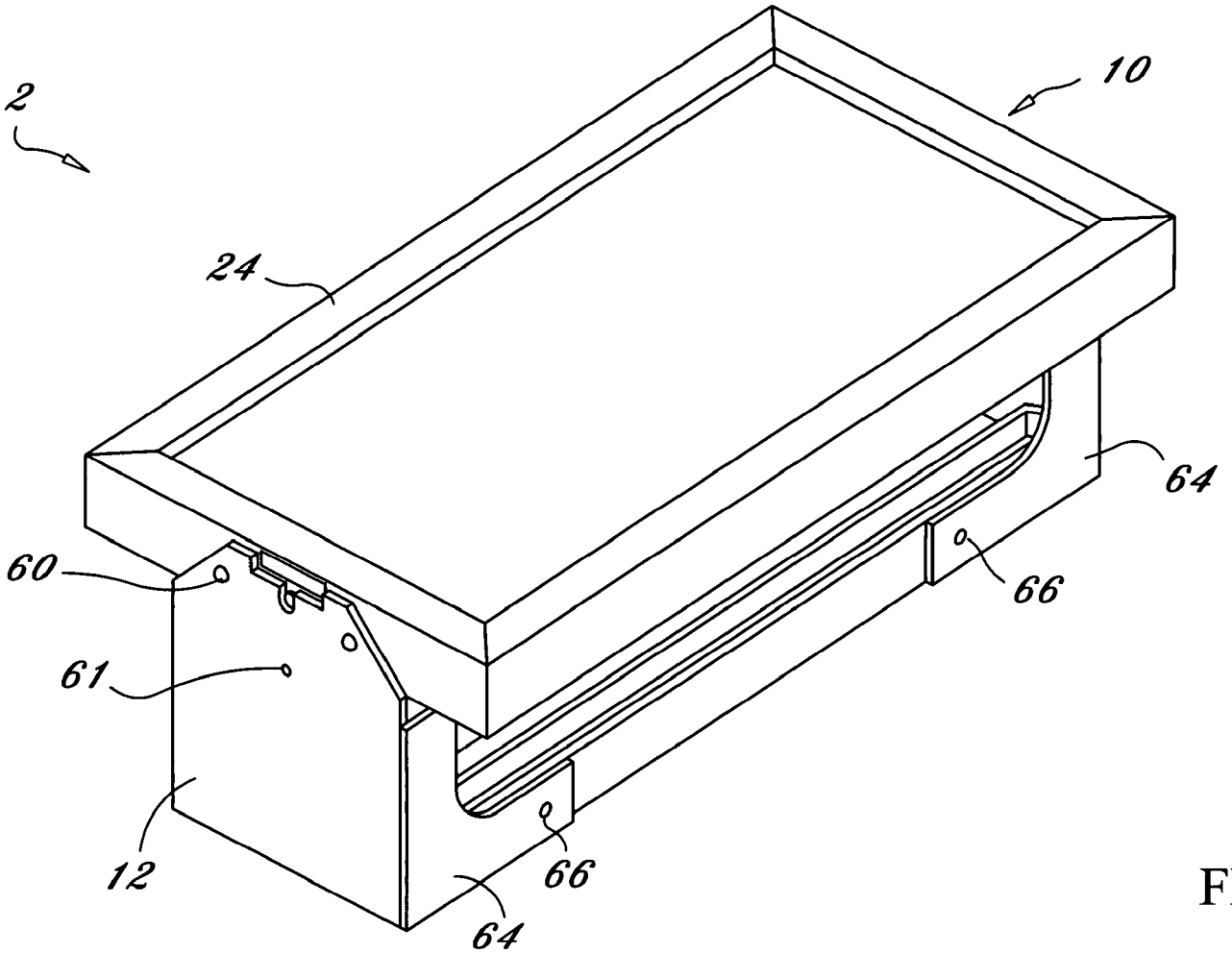

FIG. 7 is a perspective view of a second embodiment of a rotary game table in accordance with the present invention.

Figure 8:
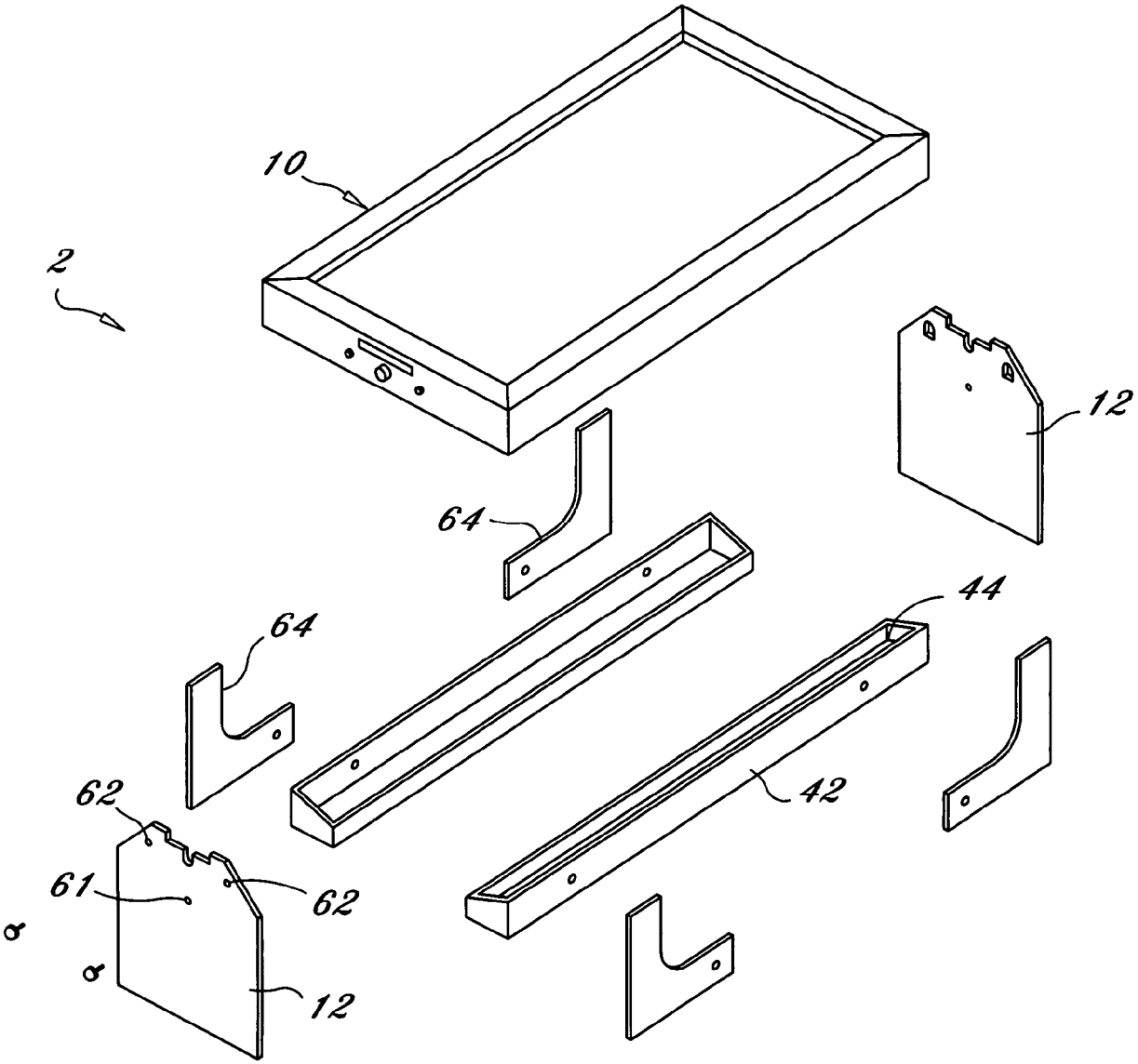

FIG. 8 is a partially exploded perspective view of a second embodiment of a rotary game table in accordance with the present invention.

Figure 9:
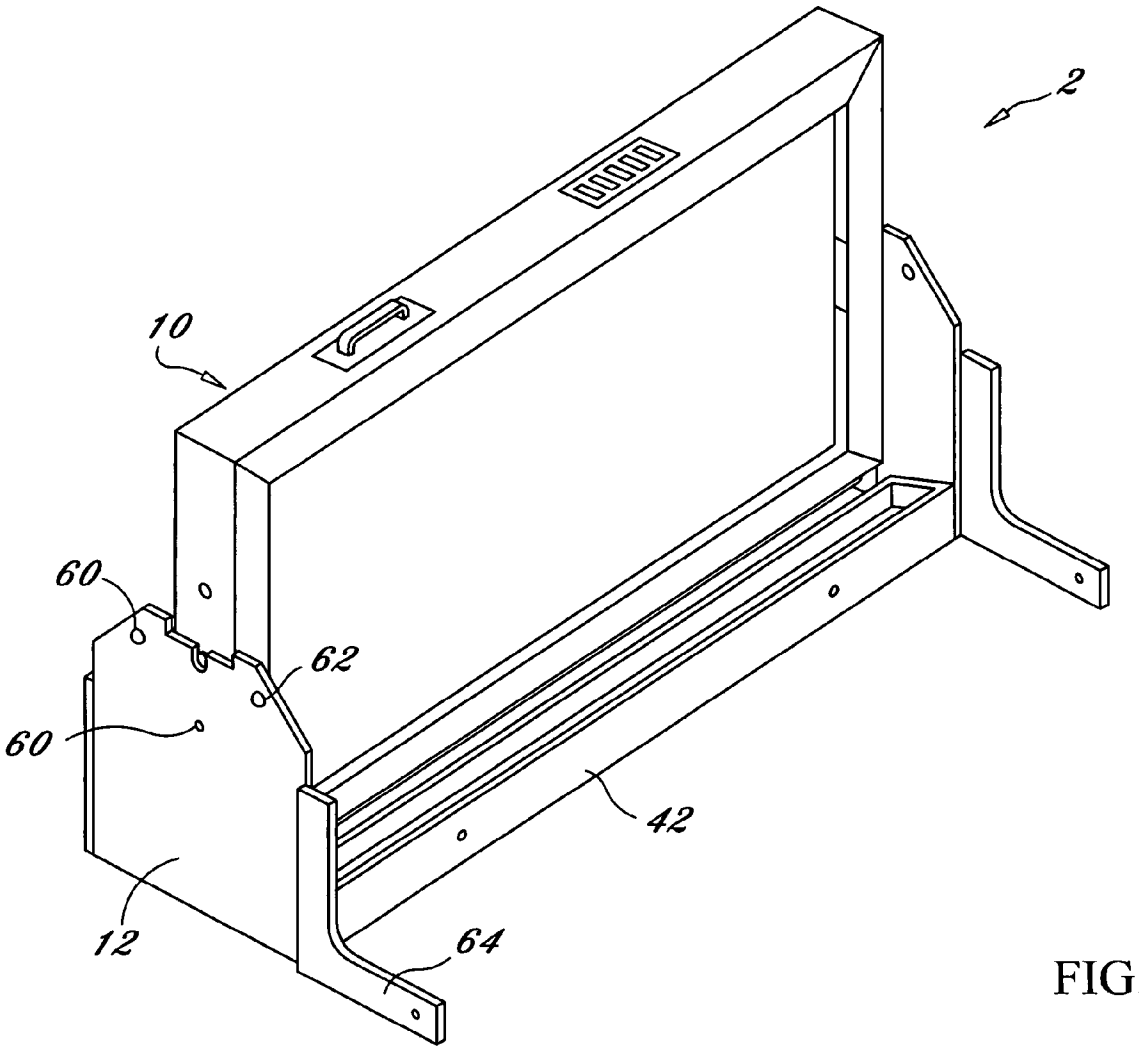

FIG. 9 is a perspective view of a second embodiment of a rotary game table with a combination game table in a vertical orientation in accordance with the present invention.

Figure 10:
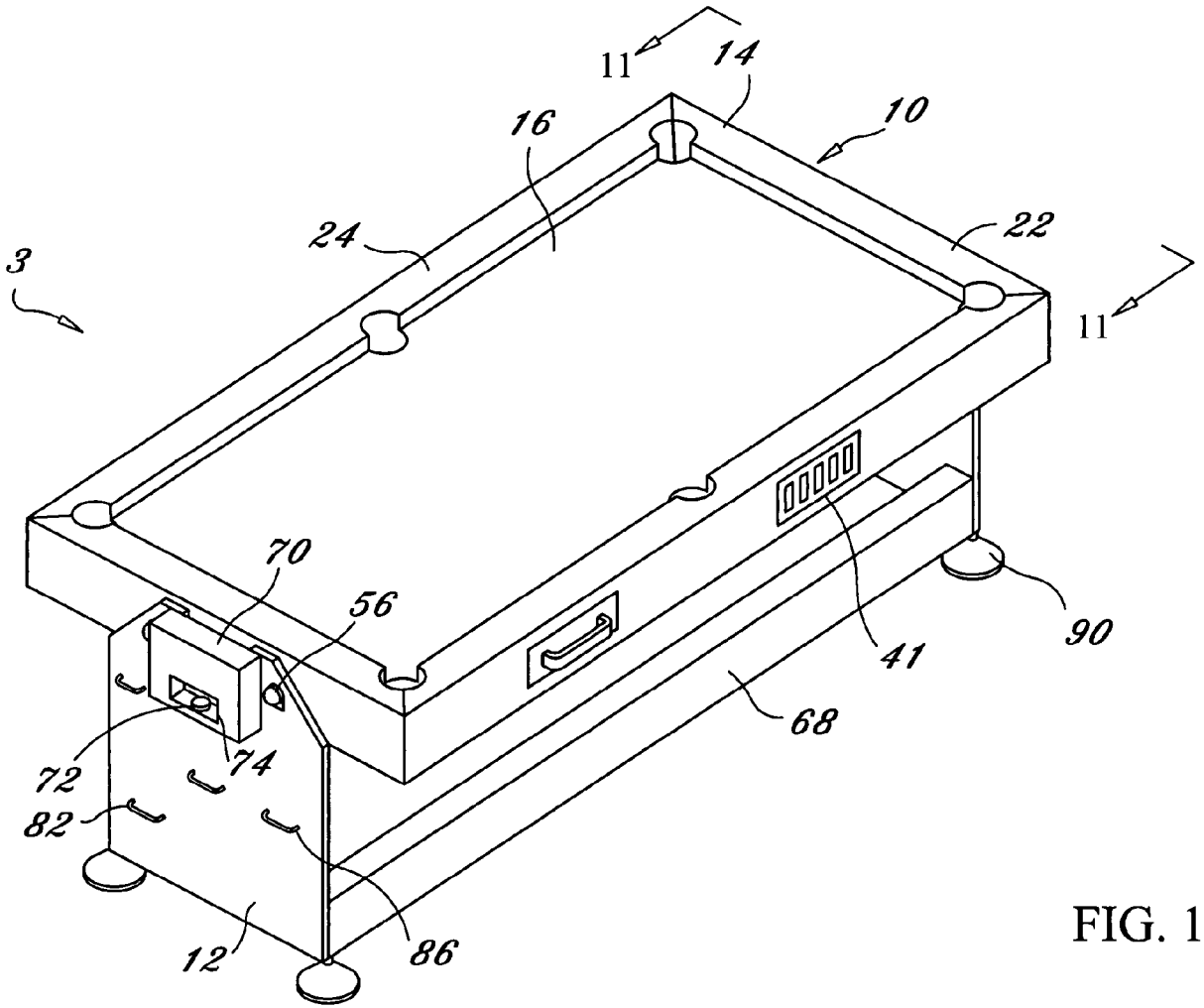

FIG. 10 is a perspective view of a third embodiment of a rotary game table in accordance with the present invention.

Figure 11:
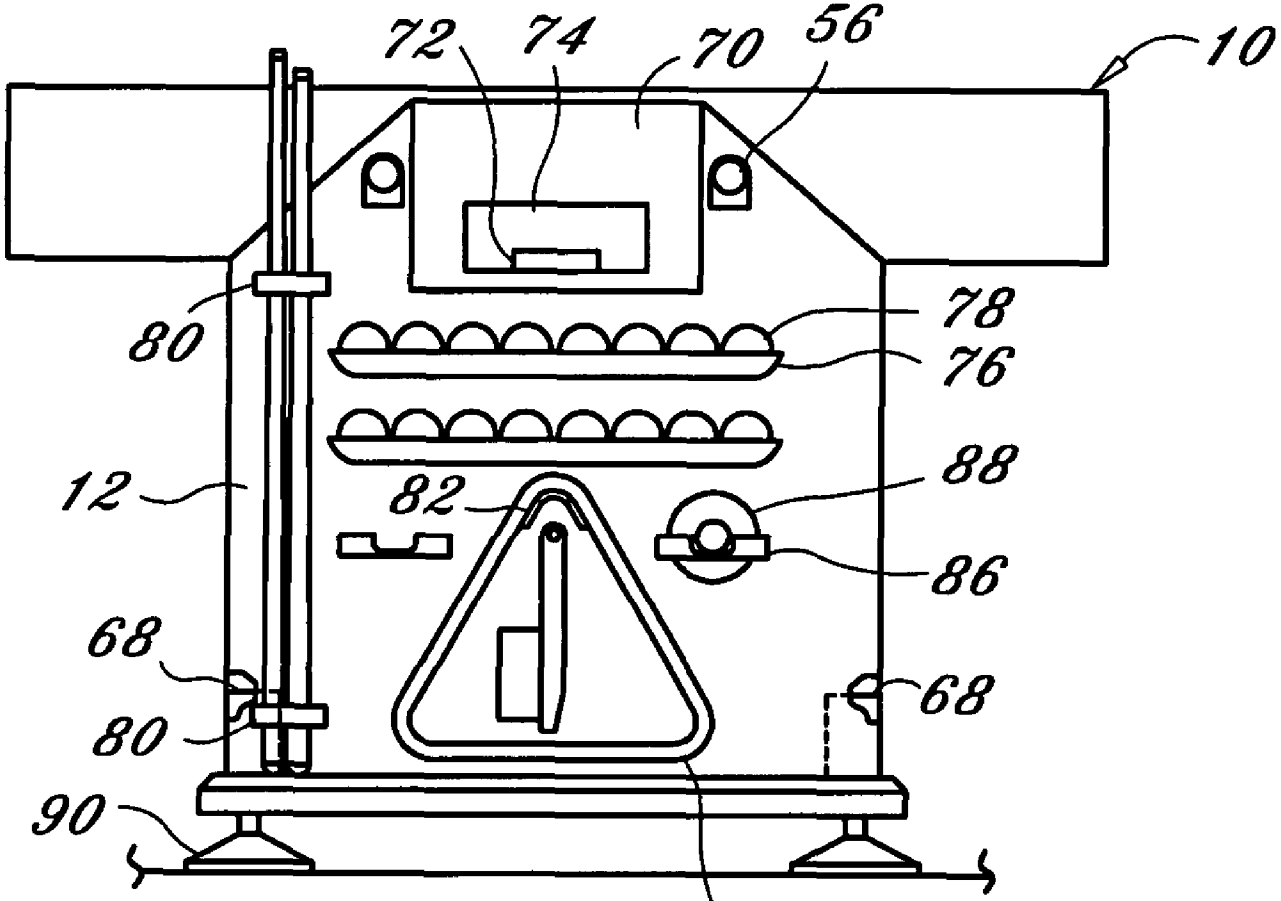

FIG. 11 is a front view of a side support member not shown in FIG. 10 of a third embodiment of a rotary game table in accordance with the present invention.

Figure 12:
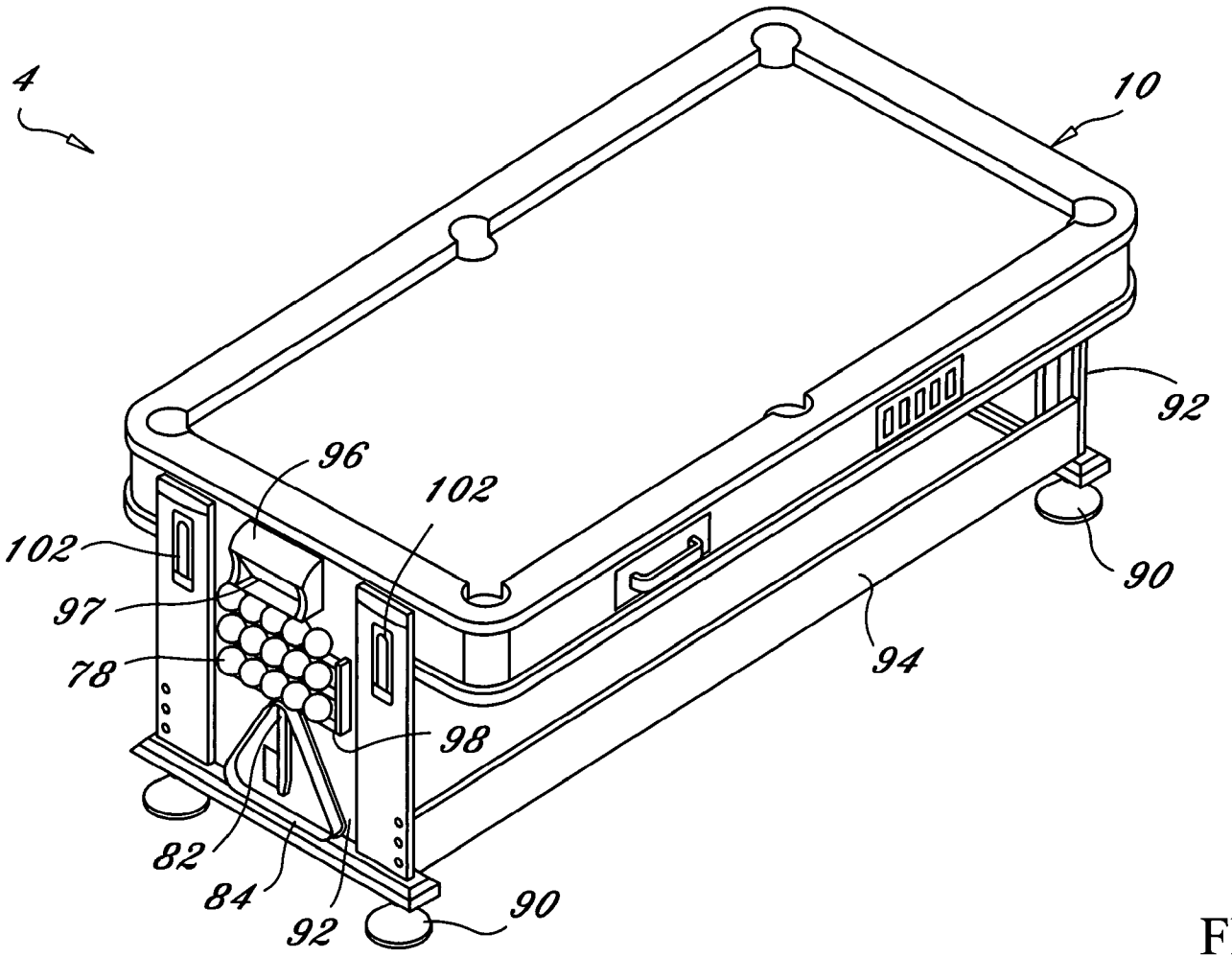

FIG. 12 is a perspective view of a fourth embodiment of a rotary game table in accordance with the present invention.

Figure 13:
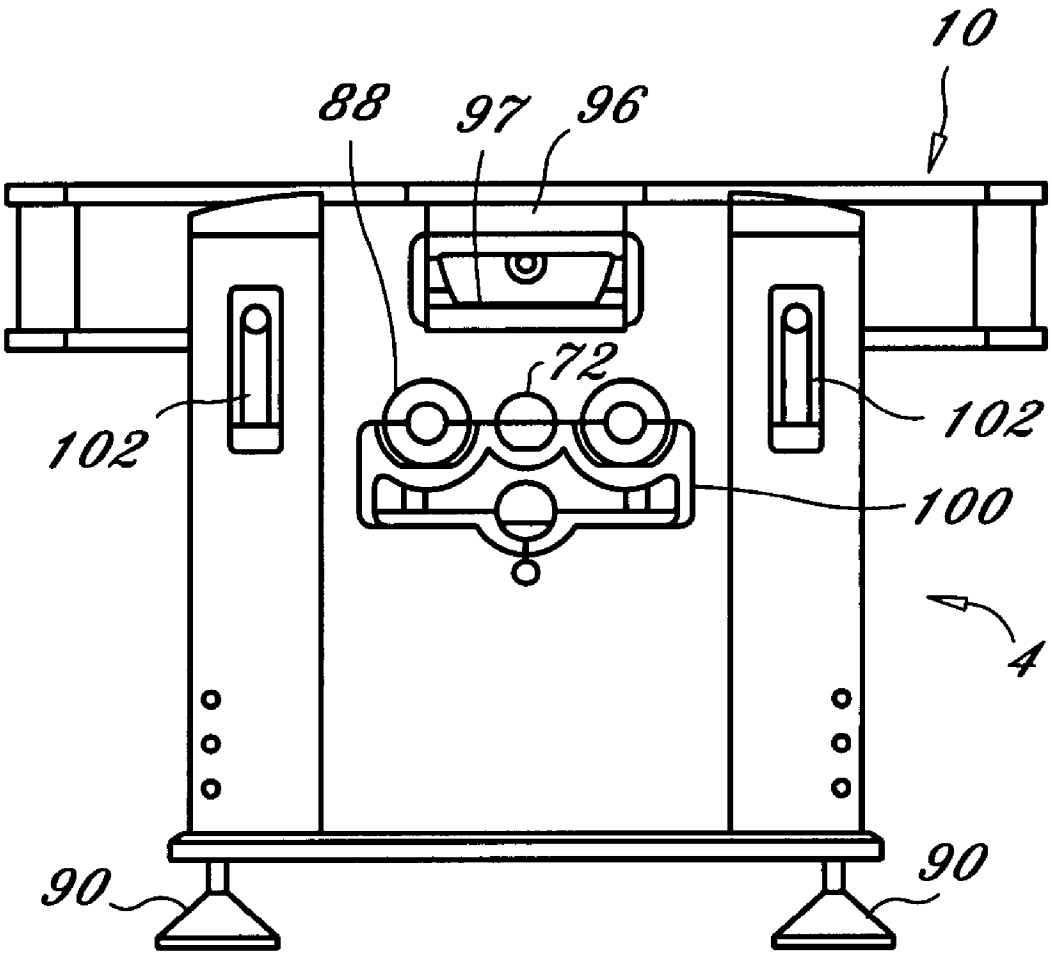

FIG. 13 is a front view of a side support member not shown in FIG. 12 of a fourth embodiment of a rotary game table in accordance with the present invention.

Figure 14:
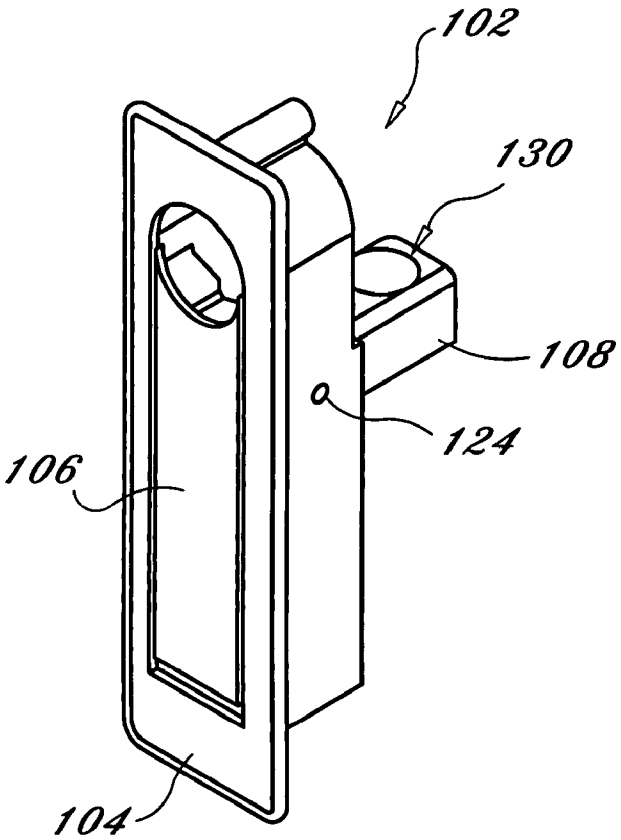

FIG. 14 is a perspective view of a support latch in a locked orientation of a fourth embodiment of a rotary game table in accordance with the present invention.

Figure 15:
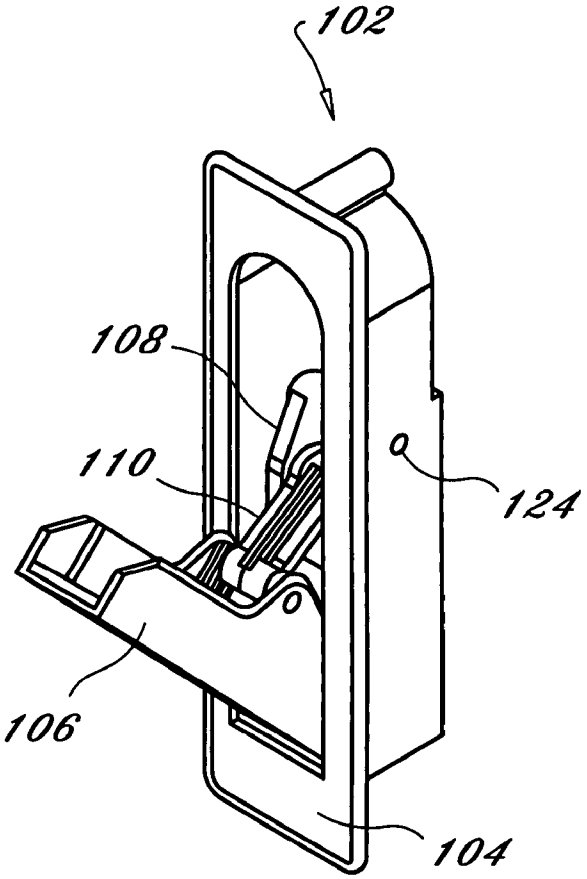

FIG. 15 is a perspective view of a support latch in a retracted orientation of a fourth embodiment of a rotary game table in accordance with the present invention.

Figure 16:
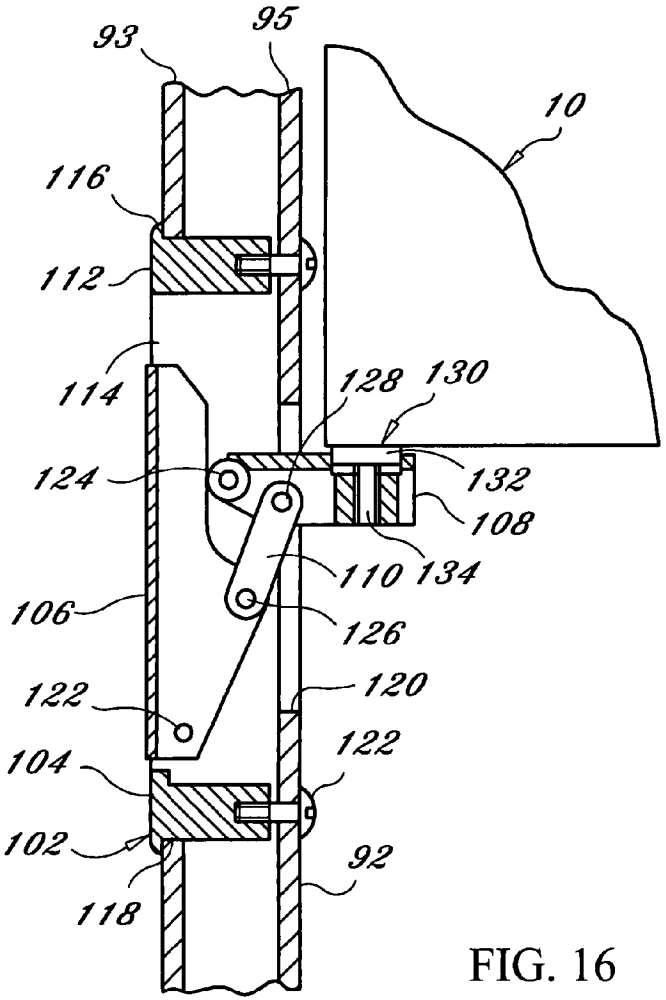

FIG. 16 is a cross sectional view of a support latch in a locked orientation of a fourth embodiment of a rotary game table in accordance with the present invention.

Figure 17:
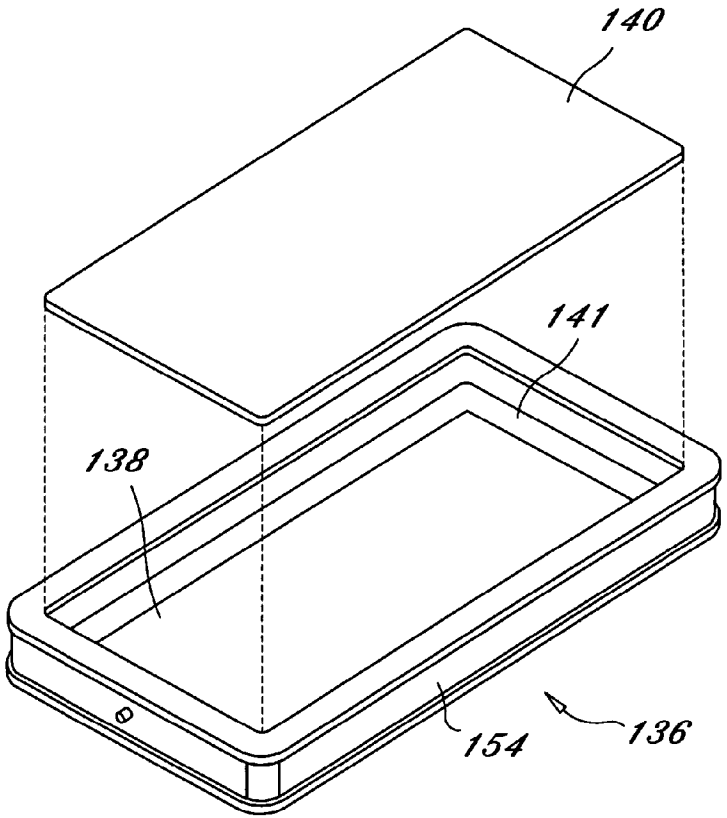

FIG. 17 is a perspective view of a combination game table with a gaming pocket on one side and a pool table surface on the other side thereof of a rotary game table in accordance with the present invention.

Figure 18:
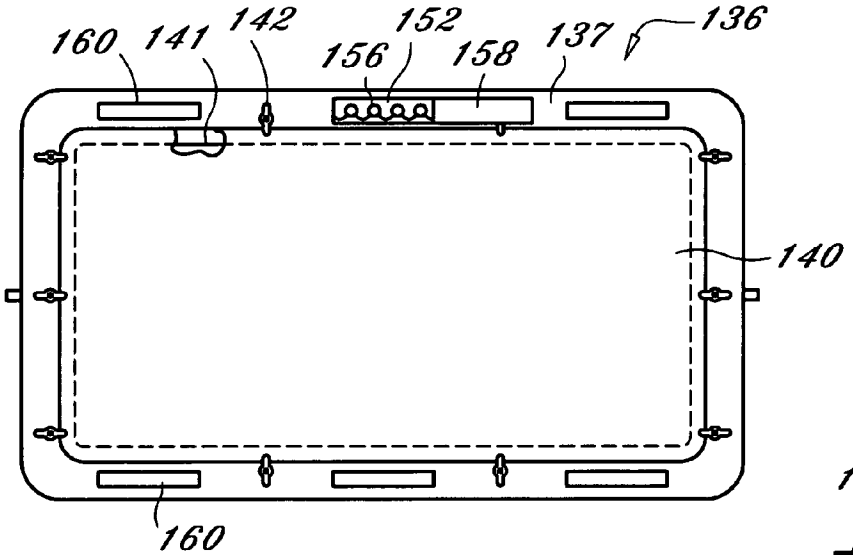

FIG. 18 is a top view of a combination game table with a gaming pocket on one side and a pool table surface on the other side thereof of rotary game table in accordance with the present invention.

Figure 19:
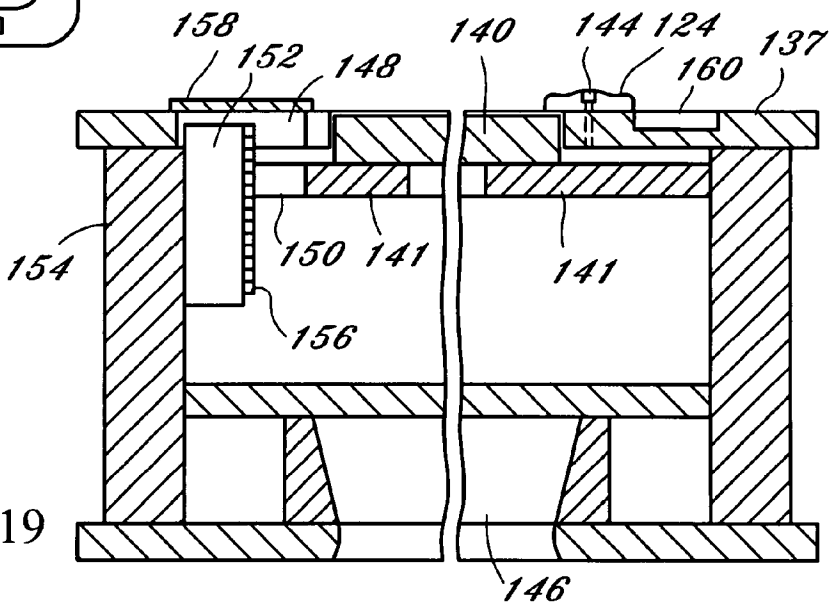

FIG. 19 is an enlarged partial cross sectional view of a combination game table with a gaming pocket on one side and a pool table surface on the other side thereof of rotary game table in accordance with the present invention.

Figure 20:
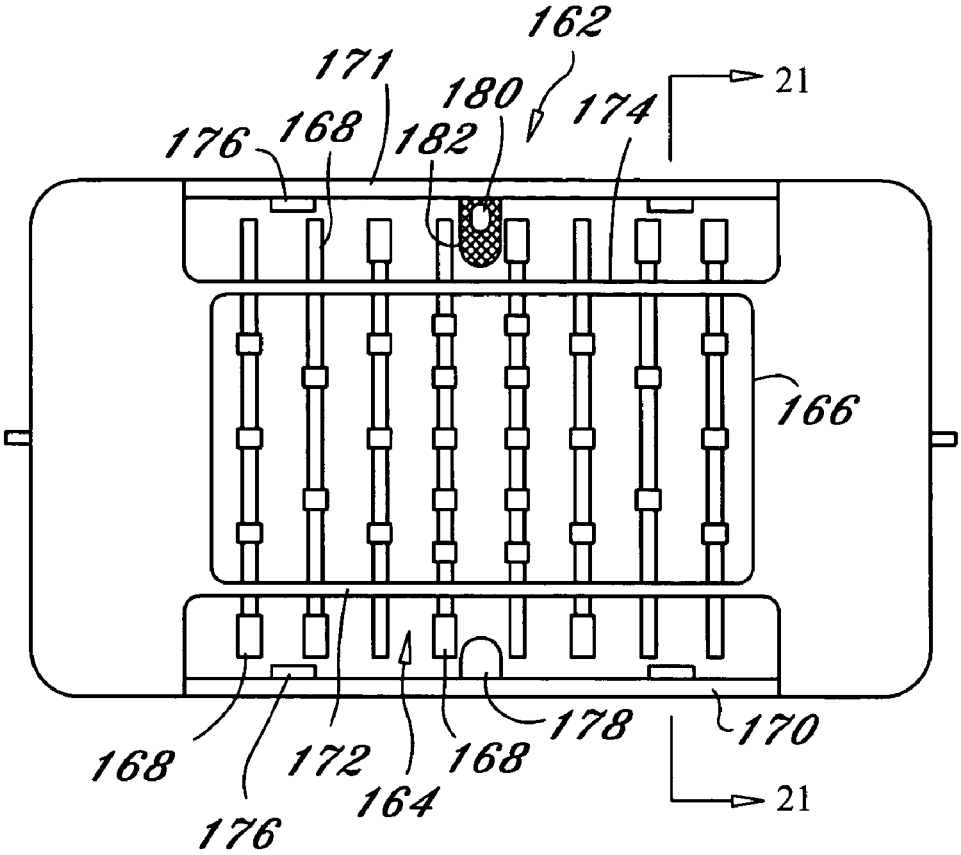

FIG. 20 is a top view of a combination game table with a table soccer game on one side and a pool table surface on the other side thereof of a rotary game table in accordance with the present invention.

Figure 21:
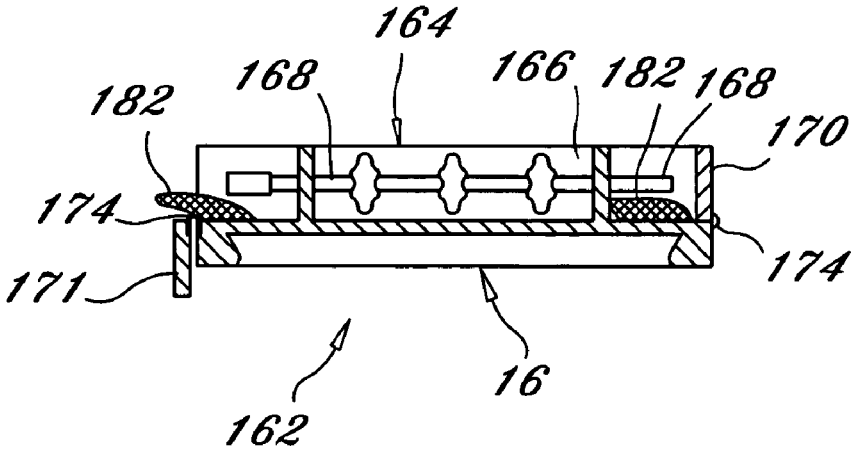

FIG. 21 is an enlarged partial cross sectional view of a combination game table with a table soccer game on one side and a pool table surface on the other side thereof of a rotary game table in accordance with the present invention.

Figure 22:
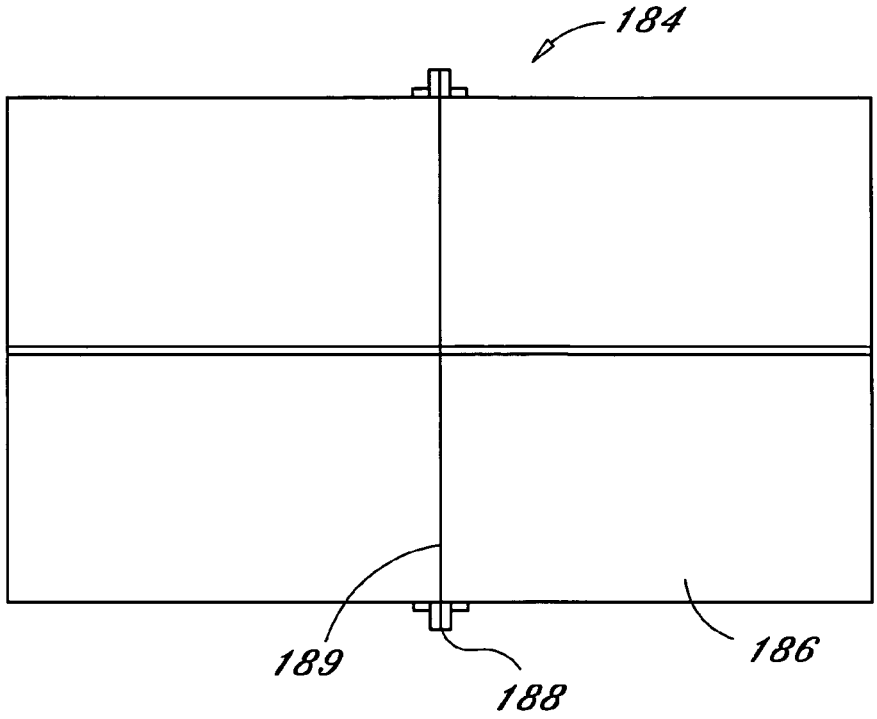

FIG. 22 is a top view of a combination game table with a ping-pong surface formed on one side and an air hockey surface formed on the other side of a rotary game table in accordance with the present invention.

Figure 23:
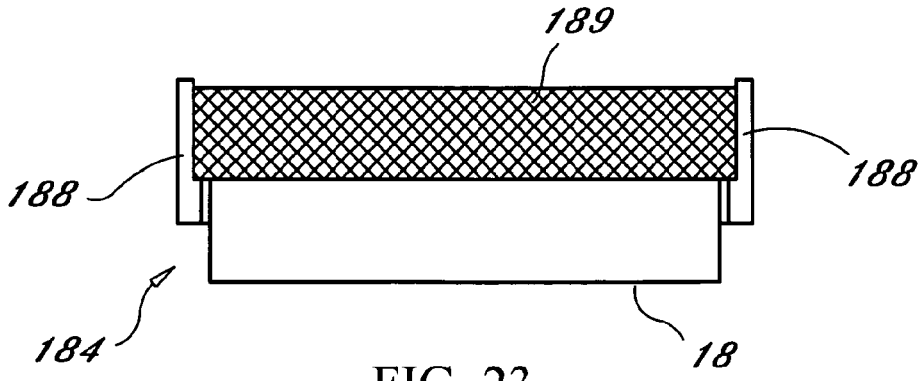

FIG. 23 is an end view of a combination game table with a ping-pong surface formed on one side and an air hockey surface formed on the other side of a rotary game table in accordance with the present invention.

Figure 24:
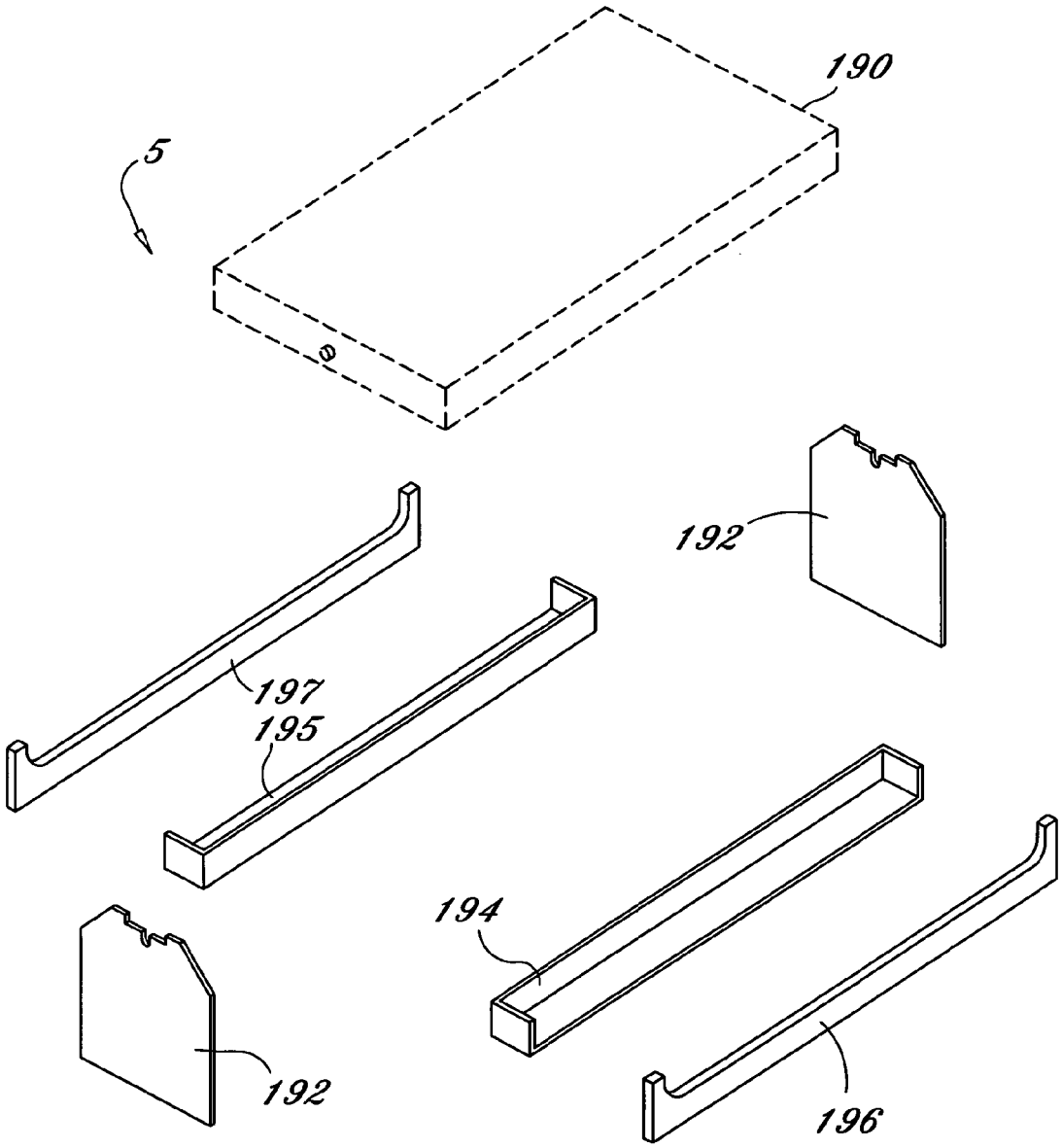

FIG. 24 is an exploded perspective view of a fifth embodiment of a rotary game table in accordance with the present invention.

Figure 25:
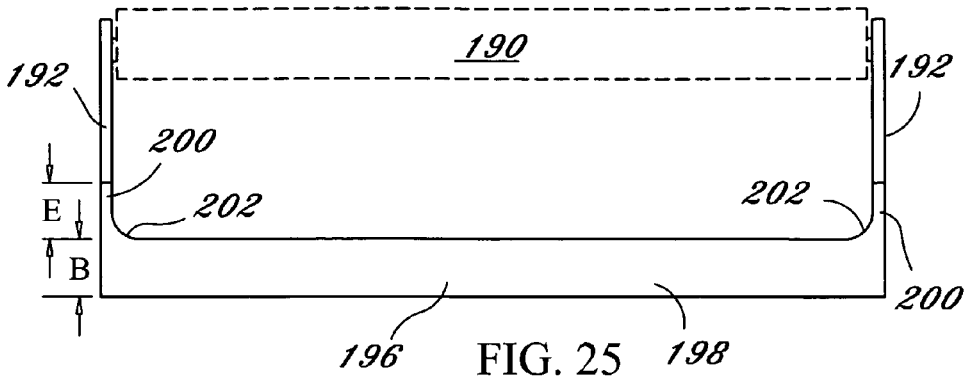

FIG. 25 is a side view of a fifth embodiment of a rotary game table in accordance with the present invention.

Figure 26:
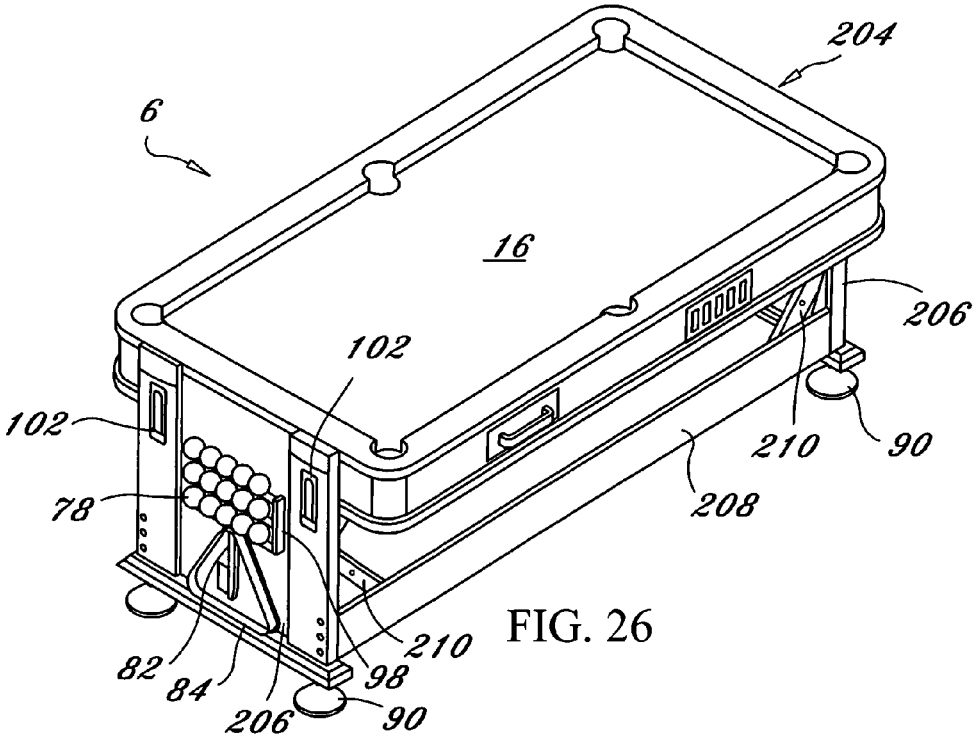

FIG. 26 is a perspective view of a sixth embodiment of a rotary game table in accordance with the present invention.

Figure 27:
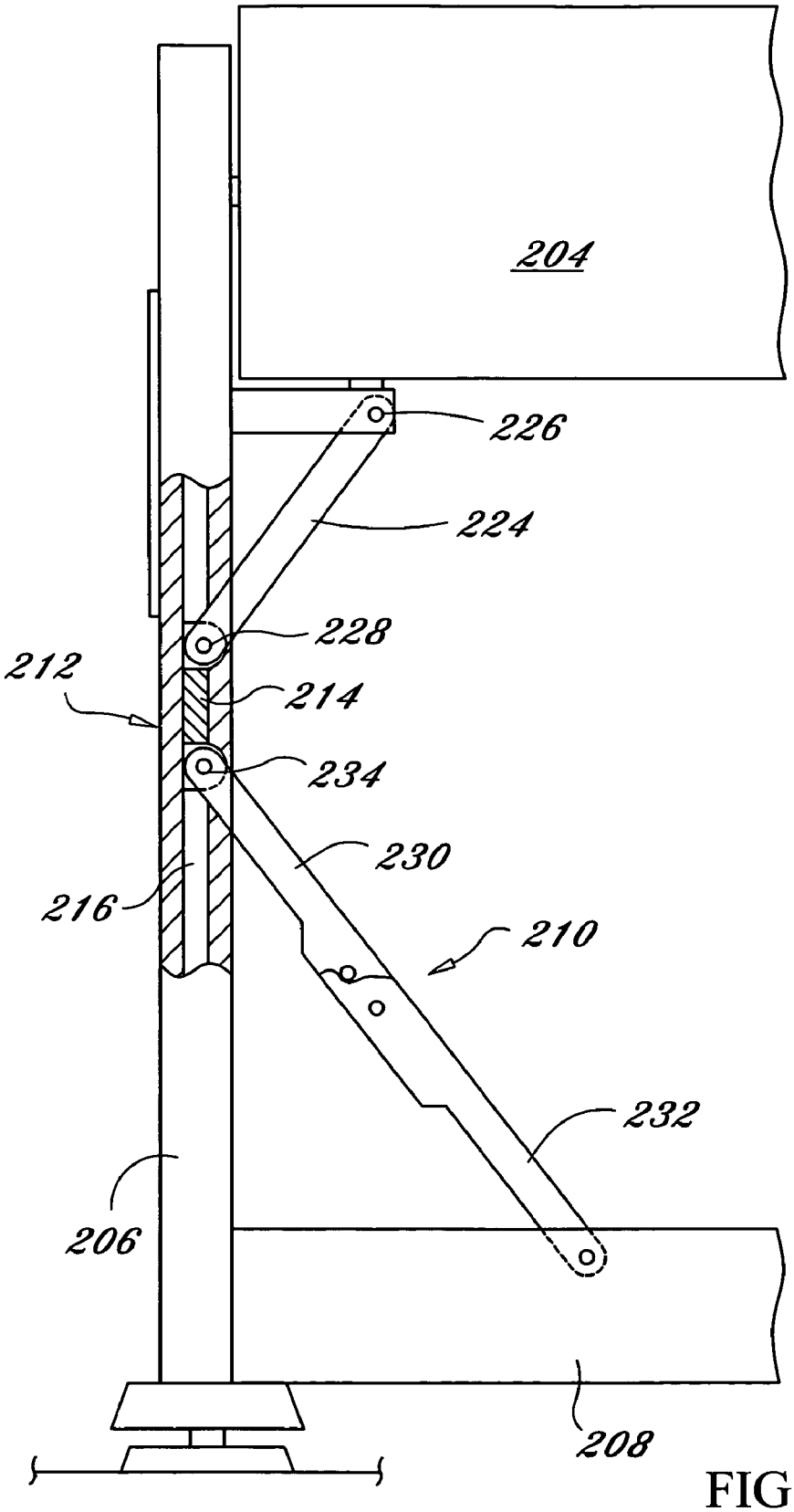

FIG. 27 is a partial side view of a sixth embodiment of a rotary game table with collapsible supports in a locked position in accordance with the present invention.

Figure 28:
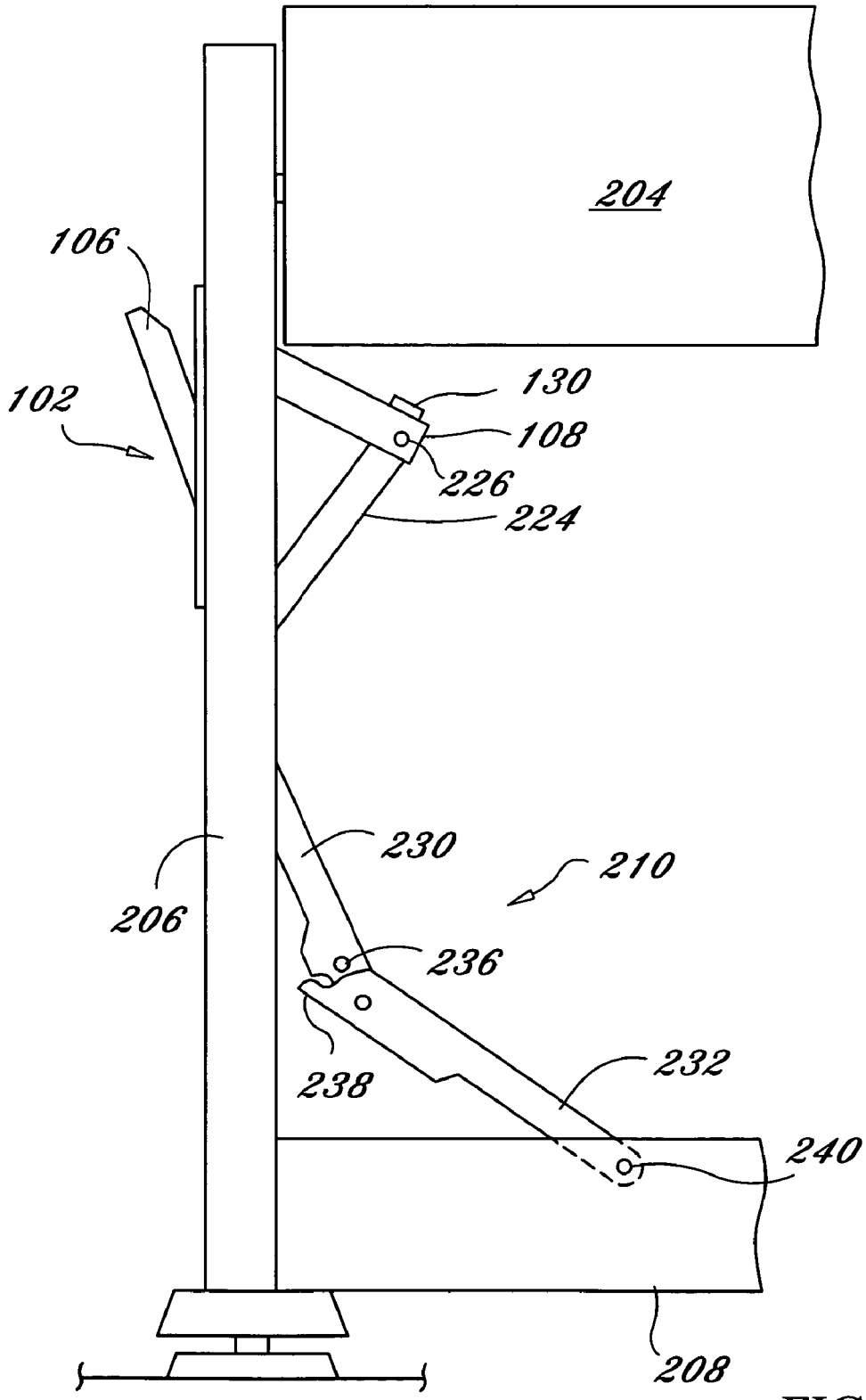

FIG. 28 is a partial side view of a sixth embodiment of a rotary game table with collapsible supports in an unlocked position in accordance with the present invention.

Figure 29:
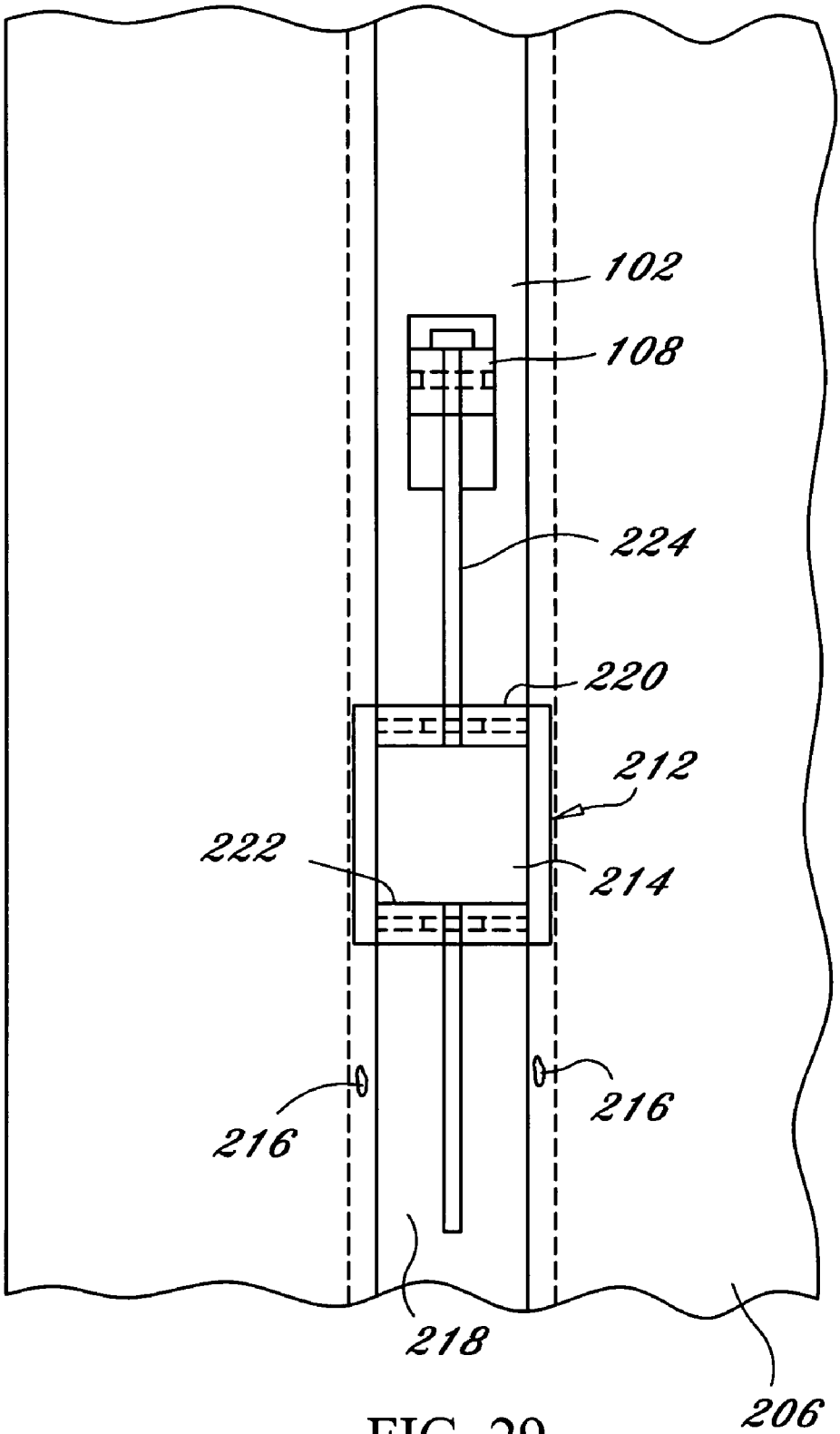

FIG. 29 is a front view of a sliding bar slidably retained in a side member of a sixth embodiment of a rotary game table in accordance with the present invention.

Figure 30:
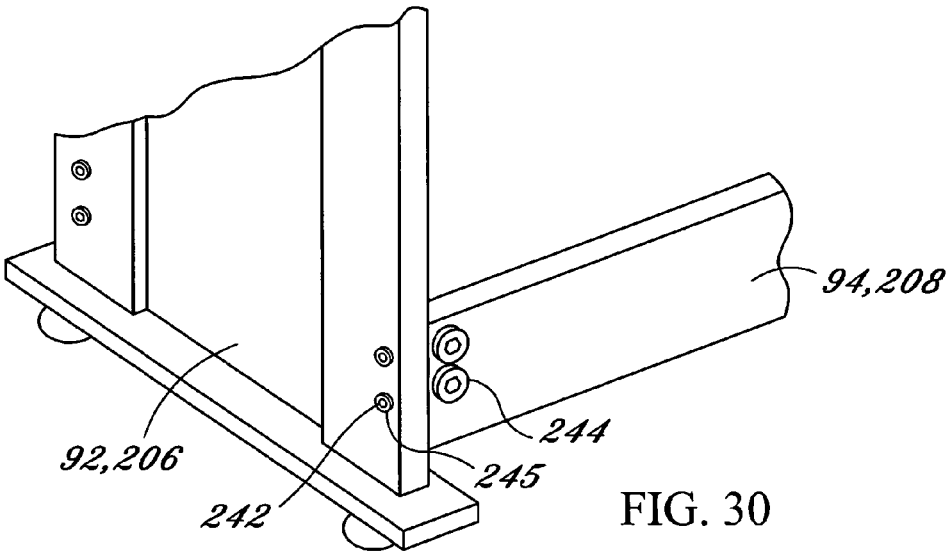

FIG. 30 is a perspective view of a method for improving the rigidity of a connection between a side support member and a cross member of a rotary game table in accordance with the present invention.

Figure 31:
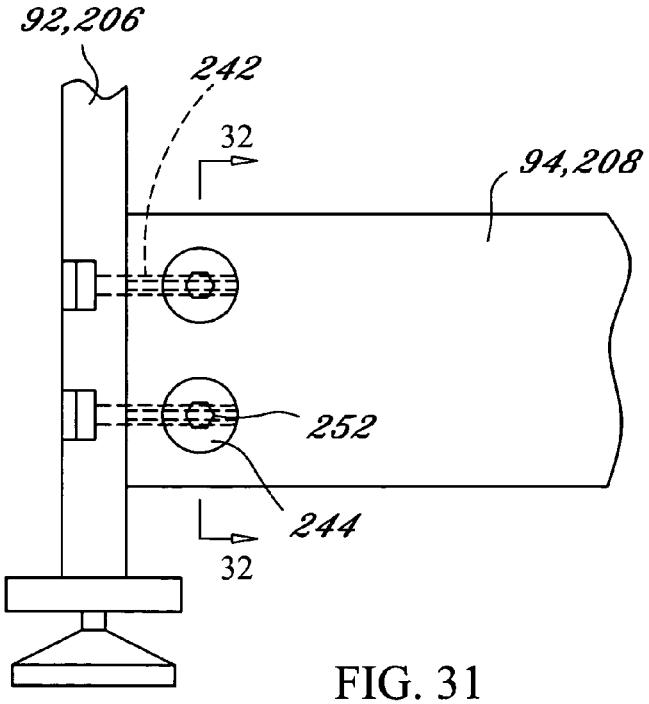

FIG. 31 is a front view of a method for improving the rigidity of a connection between a side support member and a cross member of a rotary game table in accordance with the present invention.

Figure 32:
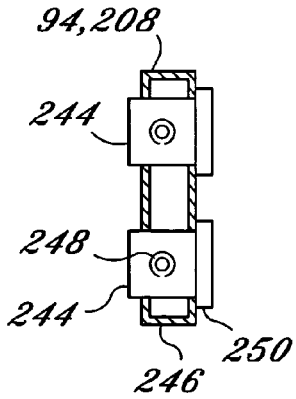

FIG. 32 is an end view of a cross member for improving the rigidity of a connection between a side support member and the cross member of a rotary game table in accordance with the present invention.

DETAILED DESCRIPTION OF THE PREFERRED EMBODIMENTS

Figure 1:
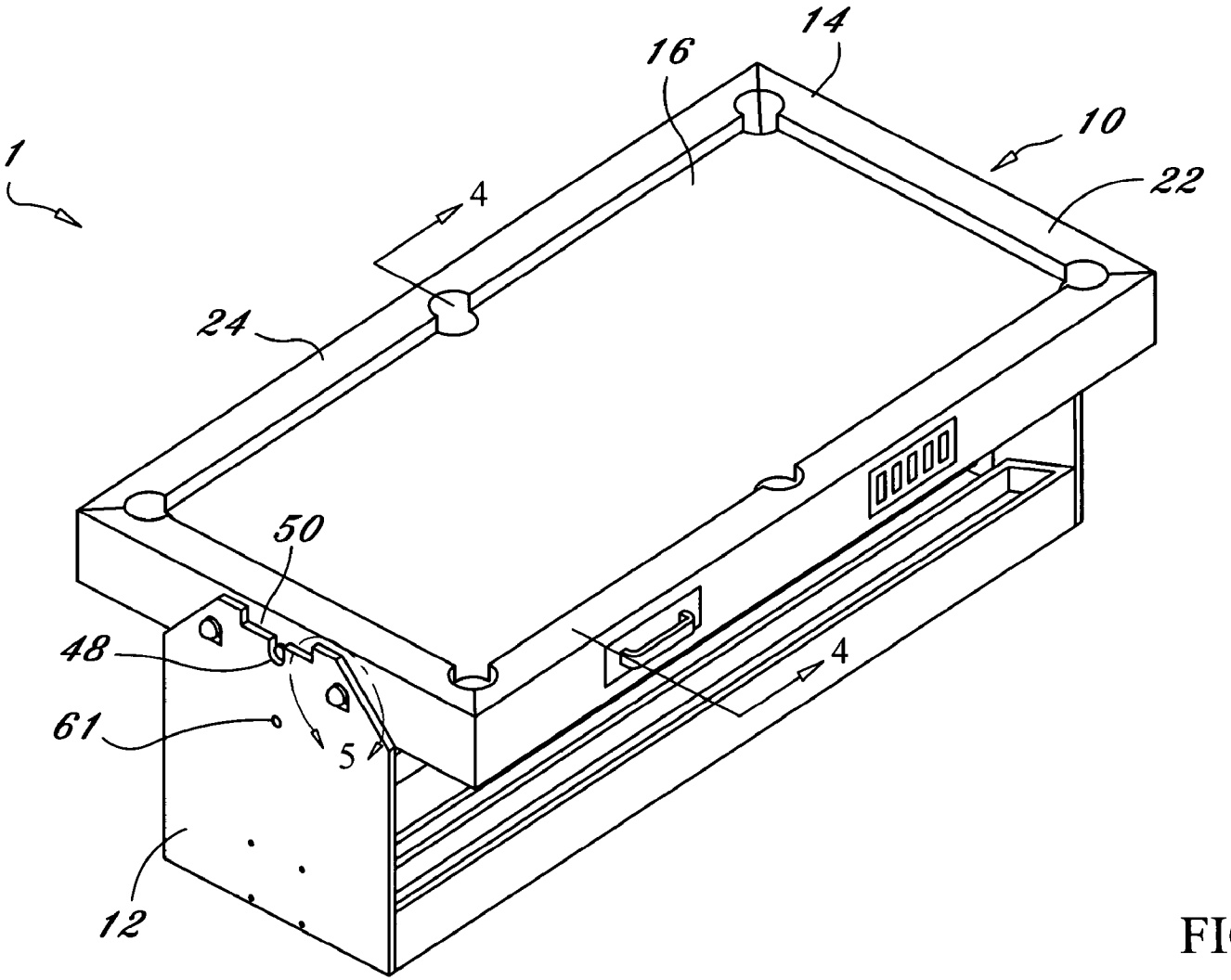
FIG. 1 is a perspective view of a rotary game table in accordance with the present invention.
Figure 2:
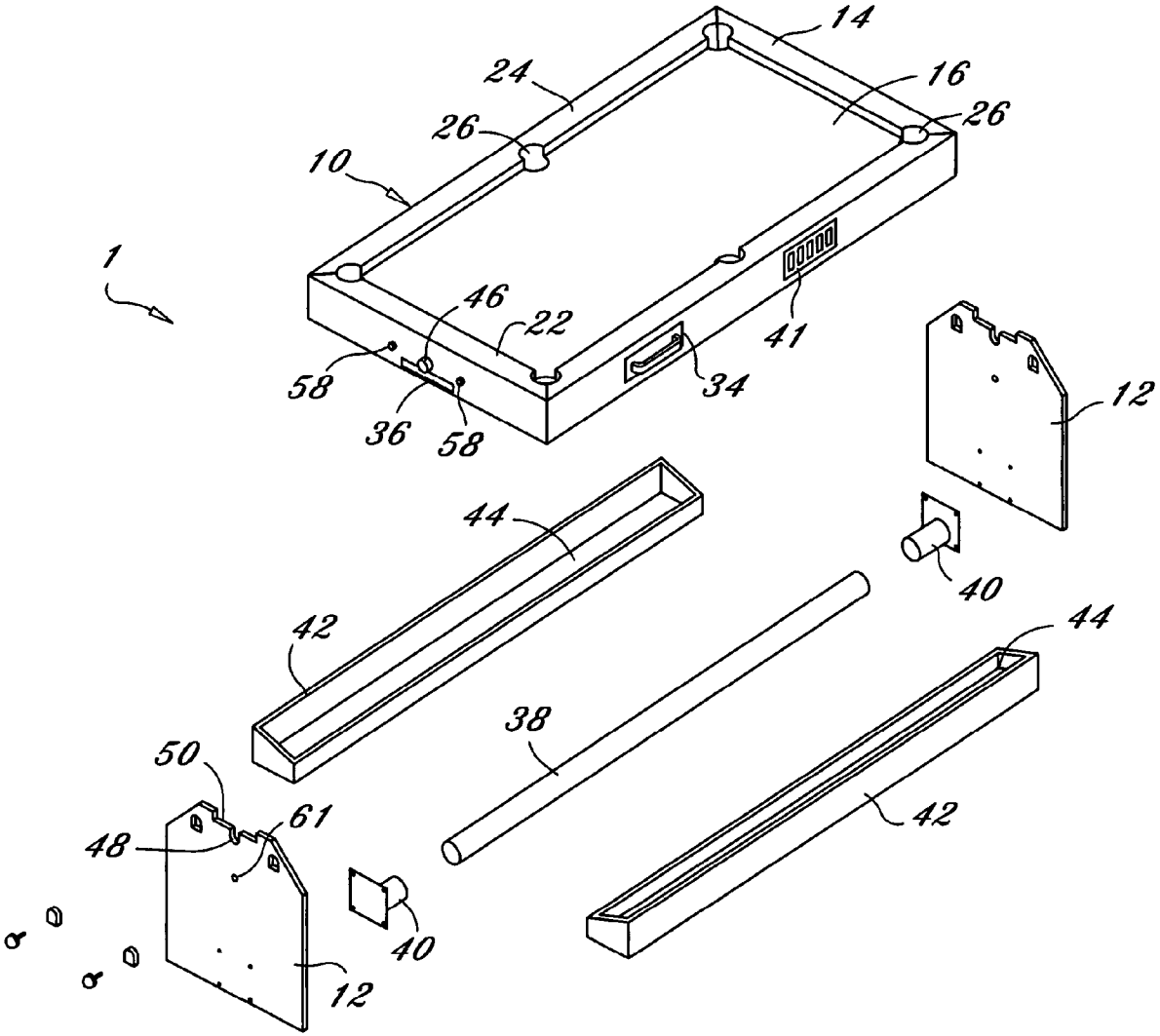
FIG. 2 is a partially exploded perspective view of a rotary game table in accordance with the present invention.
Figure 3:
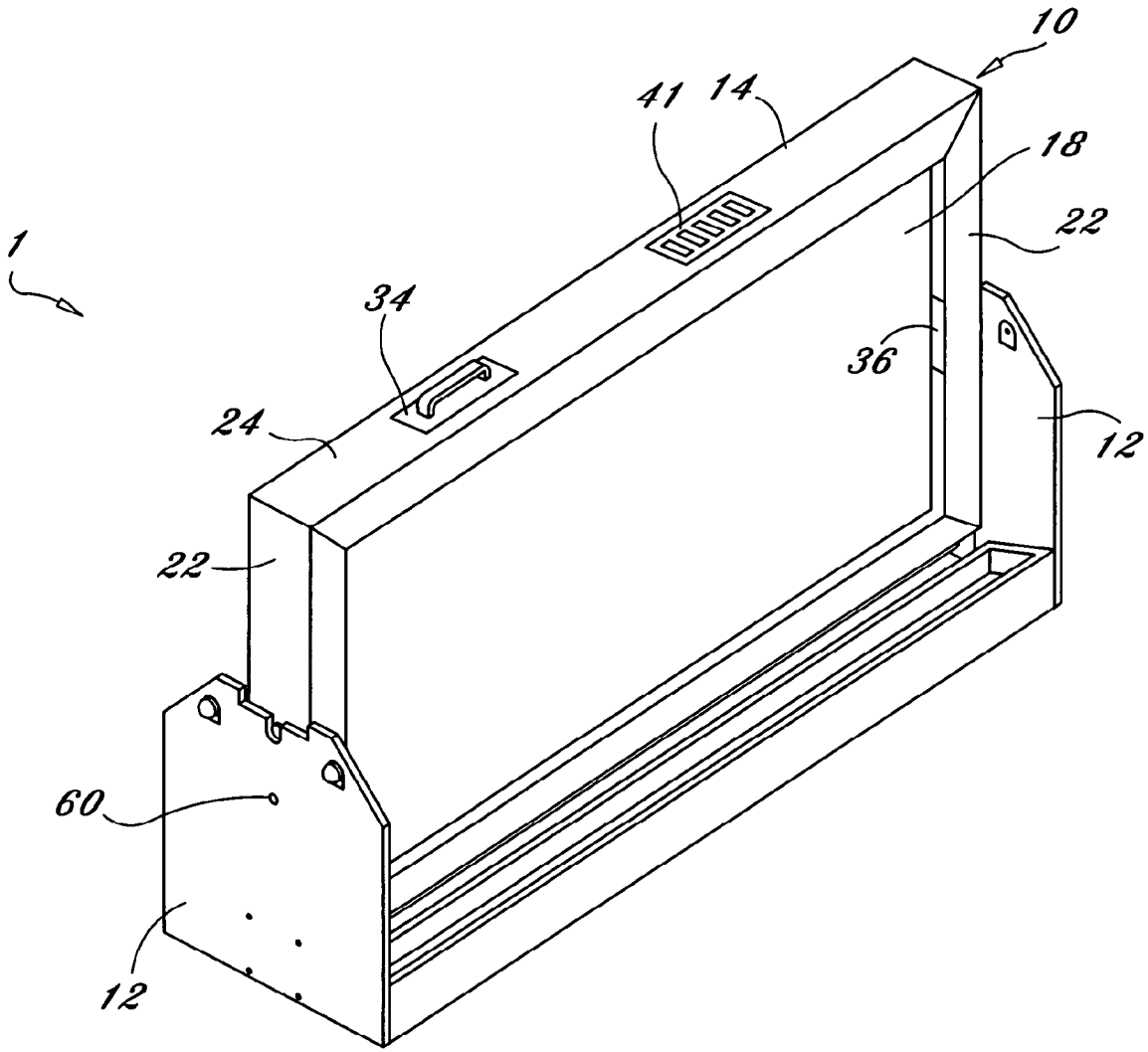
FIG. 3 is a perspective view of a rotary game table with a combination game table in a vertical orientation in accordance with the present invention.
Figure 4:
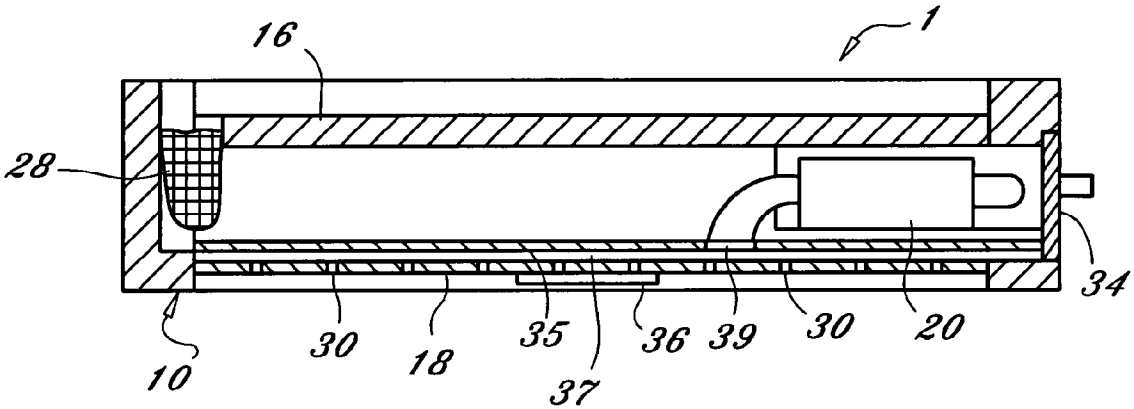
FIG. 4 is a cross sectional view of a combination game table of a rotary game table in accordance with the present invention.

With reference now to the drawings, and particularly to FIG. 1, there is shown a perspective view of a rotary game table 1. With reference to FIGS. 2-4, the rotary game table 1 includes a combination game table 10, two side support members 12 and at least one cross member. The combination game table 10 includes a game frame 14, a pool table surface 16, an air powered hockey surface 18 and an air blower 20. The pool table surface 16 is formed on one side of the combination game table 10 and an air powered hockey table surface 18 formed on the opposite side. The size of the pool table surface 16 has the same dimensions as a regulation pool table. The game frame 14 preferably includes two end frame members 22 and two lengthwise frame members 24. The two end frame members 22 are attached to the two lengthwise frame members 24 with any acceptable fastening process, such as glue or fasteners.

Figure 4A:
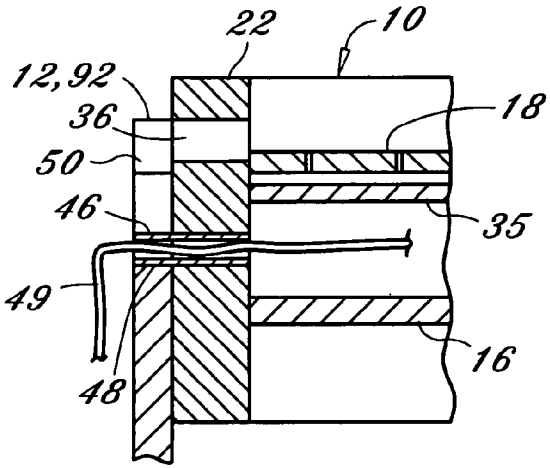
Figure 4B:
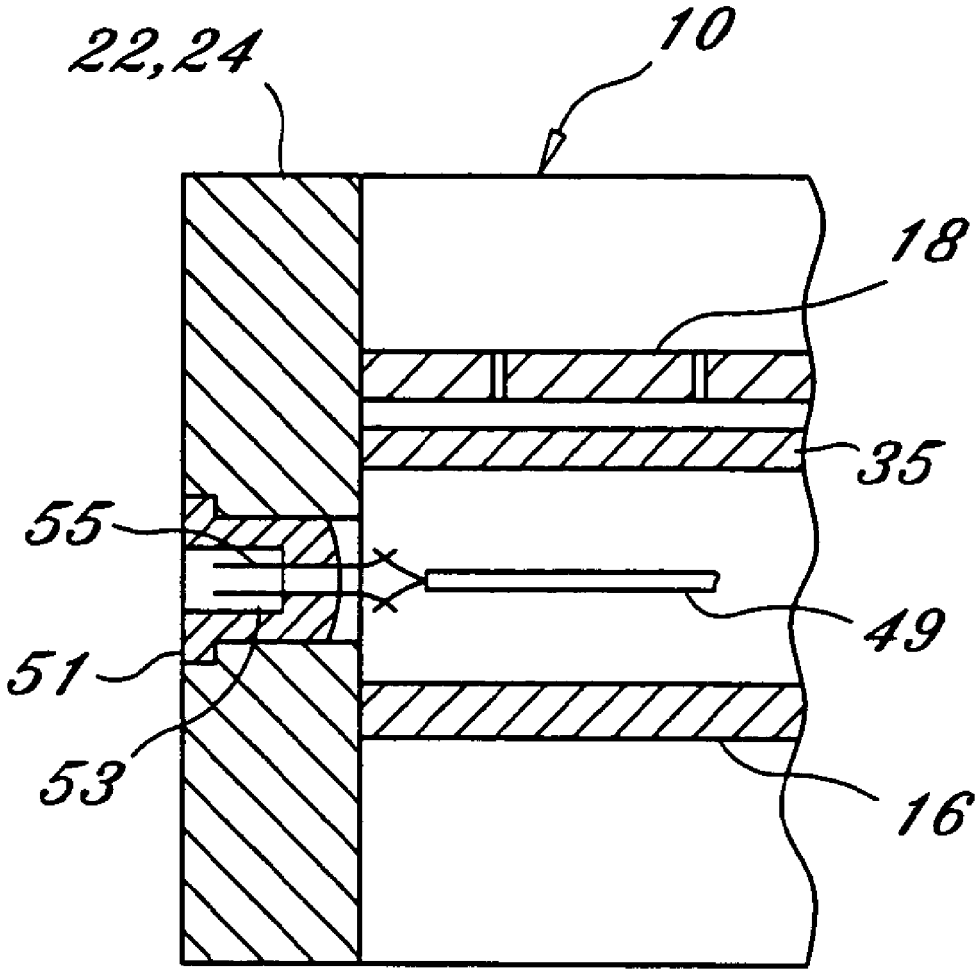
Figure 4C:
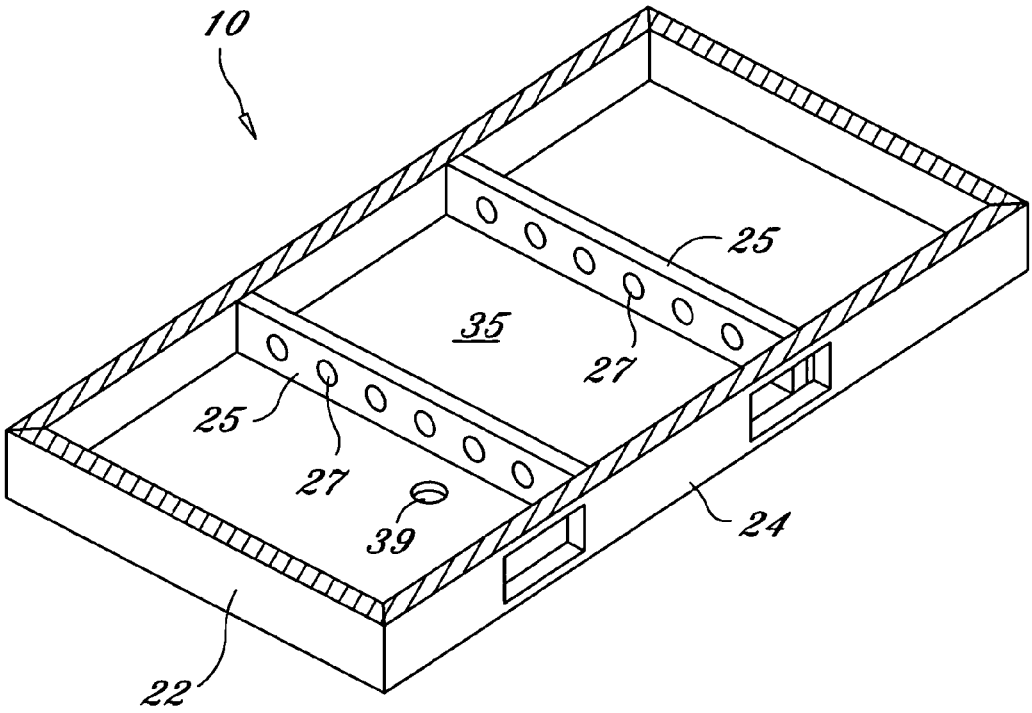

With reference to FIG. 4*c*, at least one table cross member 25 is retained between the two lengthwise frame members 24. The air blower 20 and at least one air vent 41 have been removed. The at least one table cross member 25 is used to increase the rigidity of the combination rotary table 10. At least one air passage opening 27 is formed through each table cross member 25 to the allow the flow of air to the air blower 20.

A perimeter of the pool table surface 16 is preferably attached to an inside perimeter of the game frame 14 with threaded fasteners, but other attachment methods may also be used. The air powered hockey surface 18 is preferably attached to an inside perimeter of the game frame 14 with glue, but other attachment methods may also be used. Pool ball pockets 26 are formed in the end frame members 22, the lengthwise frame members 24 and the pool table surface 16. The pool ball pockets 26 are formed substantially through a height of the end and lengthwise frame members. Preferably, a net 28 is attached to a wall of each pool ball pocket 26 to capture a billiard ball that falls therein.

The air powered hockey table surface 18 includes the plurality of air holes 30 formed therethrough. A diffuser plate 35 is disposed below the air powered hockey table surface 18 such that an air gap 37 is maintained therebetween. The air blower 20 is preferably retained in a sliding drawer 34 between the pool and air powered hockey table surfaces. An air hole 39 is formed through the diffuser plate 35 to receive an output of the air blower 20. The air blower 20 draws air from inside the combination game table 10 and preferably through the at least one air vent 41 formed through the frame 14. The air output from the air blower 20 flows through the air hole 39 into the air gap 37 created by the diffuser plate 35 and through the plurality of air holes 30 in the air powered hockey table surface 18. The drawer 34 is required to allow the air blower 20 to be removed from the combination game table 10 for replacement. A puck slot 36 is formed through each end frame member 22 to enable scoring in a game of air powered hockey.

At least one cross member 38 is preferably terminated by an end cap 40 on each end thereof. The end cap 40 is attached to an end of the at least one cross member 38 and to one of the two side support members 12 with any suitable fastening method. Preferably, an end of at least one accessory retainer 42 is attached to one of the side support members 12 with any suitable fastening method. Each accessory retainer 42 includes an accessory trough 44. The accessory trough is configured to retain a plurality of game accessories such as a plurality of billiard balls, cue sticks, a rack, a puck, and two hockey paddles. With reference to FIG. 4*a*, an electrical cord 49 is routed through a tubular pivot pin 46. The pivot pin 46 extends from each end of the combination game table 10. A pivot slot 48 is preferably formed in a top of each side support member 12, 92 to pivotally receive the pivot pin 46. The other pivot pin 46 does not have to be tubular, but may be solid. A puck clearance slot 50 is also formed in a top of each side support member 12, 92. The electrical cord 49 of the air blower 20 is preferably run through one of the pivot pins 46.

With reference to FIG. 4*b*, the electrical cord 49 is connected to a recessed male electrical plug 51. The male electrical plug 51 is inserted into an opening formed through one of the end frame members 22, or one of the lengthwise frame members 24. The male electrical plug 51 includes a recessed cavity 53 and two electrical prongs 55, which are connected to the electrical cord 49.

With reference to FIG. 5, at least one locking pin device 52 is disposed in at least one of the two side support members 12. The locking pin device 52 includes a locking body 54 and a spring pin 56. The spring pin 56 is retained in the locking body 54. The spring pin 56 is spring loaded inside the locking body 54; such that the spring pin 56 is biased in an extended position. At least one pin cavity 58 is formed in at least one end of the combination game table 10 to receive the at least one the spring pin 56. The at least one spring pin 56 is withdrawn from the at least one pin cavity 58 to allow the game table to be rotated for storage or to change the game surface. Spring loaded locking pins are well known in the art and need not be explained in detail. With reference to FIG. 6, the locking pin device 52 may be replaced with a separate locking pin 60.

With reference to FIG. 8, a pin hole 62 is formed through the side support member 12 instead of attaching the locking pin device 52. The locking pin 60 is withdrawn from each side support member 12 to allow rotation of the combination game table 10. To retain the combination game table 10 in a vertical orientation, a pin hole 61 is formed through at least one side support member 12. The pin hole 61 is disposed in the side support member 12 to be concentric with the at least one pin cavity 58. The locking pin 60 is inserted through the pin hole 61 and into the at least one pin cavity 58.

With reference to FIGS. 7-9, a second embodiment of a rotary game table 2 includes a combination game table 10, two side support members 12, at least two pivotal support arms 64 and at least one cross member. The combination game table 10 is the same as that of the rotary game table 1. Preferably, at least one accessory retainer 42 acts as the at least one cross member. One of the two side support members 12 is attached to each end of the at least one accessory retainer 42 with any suitable fastening process. The combination game table 10 is pivotally retained by a single side support member 12 on each end thereof. Each pivotal support arm 64 is pivotally attached to one end of the side support member 12 with at least one hinge or any other suitable pivotal retention device.

To rotate the combination game table 10, the pivotal support arms 64 are swung outward such that they are parallel with the side support members 12. The pivotal support arms 64 are swung inward to retain the combination game table 10 in a horizontal orientation. Each pivotal support arm 64 is attachable to a single accessory retainer 42 with any suitable quick release fastener 66. Quick release fasteners are well known in the art and need not be explained in detail. Use of the at least two pivotal support arms 64 eliminates the need for the use of locking pin devices 52 or locking pins 60. However, the locking pin devices 52 or locking pins 60 may also be used in conjunction with the four pivotal support arms 64.

With reference to FIGS. 10-11, a third embodiment of a rotary game table 3 includes a combination game table 10, two side support members 12 and at least one cross member 68. The combination game table 10 is the same as that of the rotary game table 1. One of the two side support members 12 is attached to each end of the at least one cross member 68 with any suitable fastening process. The combination game table 10 is pivotally retained by a single side support member 12 on each end thereof.

A hockey puck housing 70 is preferably attached to the support member 12. When a player is successful in scoring, a hockey puck 72 will fall into a puck tray 74 in the hockey puck housing 70. At least one ball tray 76 is preferably mounted to one of the two side support members 12 to retain a plurality of billiard balls 78. At least two pool cue racks 80 are preferably attached to at least one side support member 12. A rack holder 82 is preferably attached to one of the two side support members 12 to retain a rack 84. At least one paddle holder 86 preferably retains a single hockey paddle 88. To rotate the combination game table 10, at least one spring pin 56 of the at least one locking pin device 52 is withdrawn from the at least one pin cavity 58 to allow the game table to be rotated for storage or to change the game surface.

At least one locking pin 60 may be substituted for the at least one locking pin device 52. Further, the at least two pivotal support arms 64 of the second embodiment may also be substituted for the at least one locking pin device 52. Each pivotal support arm 64 would be pivotally attached to a single side support member 12 with at least one hinge or any other suitable pivotal retention device. Each pivotal support arm 64 would be attached to a single cross member 68 with any suitable quick release fastener 66. Quick release fasteners are well known in the art and need not be explained in detail. Four height adjustable feet 90 are preferably used to level the rotary game table 3. The four height adjustable feet 90 may also used on the rotary game table 1, 2.

With reference to FIGS. 12-13, a fourth embodiment of a rotary game table 4 includes a combination game table 10, two side support members 92 and at least one cross member 94. The combination game table 10 is the same as that of the rotary game table 1. One of the two side support members 92 is attached to each end of the at least one cross member 94 with any suitable fastening process. The combination game table 10 is pivotally retained by a single side support member 92 on each end thereof.

A hockey puck housing 96 is preferably attached to each side support member 92. When a player is successful in scoring, the hockey puck 72 will fall into a puck tray 97 in the hockey puck housing 96, disposed on each side support member 92. At least one ball tray 98 is preferably mounted to one of the two side support members 92 to retain a plurality of billiard balls 78. A rack holder 82 is preferably attached to one of the two side support members 12 to retain a rack 84. A paddle/puck holder 100 preferably retains the hockey puck 72 and two hockey paddles 88. Four height adjustable feet 90 are preferably used to level the rotary game table 4.

With reference to FIGS. 14-16, a pair of support latches 102 are retained in at least one of the two side support members 92 with any suitable fastening method. The support latch 102 includes a latch frame 104, a latch lever 106, a support link 108 and a latch link 110. The latch frame 104 includes a lever housing 112 with a substantially rectangular opening 114 formed therethrough. A flange 116 is preferably formed on a front periphery of the lever housing 112. The side support member 92 is shown as having a first wall 93 and a second wall 95. However, the side support member 92 may also be solid, or partially hollow and partially solid.

A first latch opening 118 is formed through the first wall 93 to receive the outer periphery of the lever housing 112. A second latch opening 120 is formed through the second wall 95 to provide clearance for the movement of the support link 108. The latch lever 102 is preferably retained in the side support member 92 with at least two fasteners 122. The substantially rectangular opening 114 is sized to receive the latch lever 106. The latch lever 106 is pivotally retained by the latch frame 104 with a lever pin 122 or the like. The support link 108 is pivotally retained by the latch frame 104 with a support pin 124 or the like, adjacent the latch lever 106. One end of the latch link 110 is pivotally retained by the lever 106 with a first link pin 126 and the other end of the latch link 110 is pivotally retained by the support link 108 with a second link pin 128 or the like. FIG. 14 shows the support latch 102 in a locked position and FIG. 15 shows the support latch 102 in a retracted position.

A slack adjuster 130 extends from a top of each support link 108. The slack adjuster ensures that the combination game table 10 does not rock or wobble, when both support latches 102 are in a locked position. The support link 108 is in a support position, when the support latch is in a locked position and the support link 108 is in a retracted position, when the support latch is in a retracted position. The slack adjuster 130 preferably includes a contact base 132 and a threaded rod 134 extending from a bottom of the contact base 132. The contact base 132 is preferably fabricated from a resilient material to prevent damage to the combination game table 10. A threaded hole is formed in the support link 108 to threadably receive the threaded rod 134. The slack adjuster 130 is rotated upward to prevent the combination game table 10 from pivoting relative to the two side support members 92. The combination game table 10 is rotated by retracting the two support latches 102 in at least one side support member 92. After the combination game table 10 is rotated to the opposite game surface, the support latches 102 are locked.

To retain the combination game table 10 in a vertical orientation, a pin hole would be formed through at least one side support member 92, similar to the pin hole 61 shown in FIG. 7. The at least one pin cavity 58 would be formed in the combination game table 10 as shown in FIG. 2, concentric with the pin hole 61. The locking pin 60 is inserted through the pin hole 61 and into the at least one pin cavity 58 to retain the game table 10 in a vertical orientation.

With reference to FIGS. 17-19, one side of a combination game table 136 includes a gaming pocket 138 that is sized to receive a gaming insert 140. The combination game table 136 may be substituted for the combination game table 10 in any of the preferred embodiments 1-4. The gaming pocket 138 is formed through a gaming plate 137. The gaming insert 140 may be a roulette table, a black jack table, a craps table or any other appropriate gambling table. A support rim 141 preferably supports the gaming insert 140 and acts a bottom of the gaming pocket 138. A plurality of lock clips 142 are used to retain the gaming insert 140 in the gaming pocket 138. Each lock clip 142 is preferably retained with a screw 144. One end of each lock clip 142 is twisted over the gaming insert 140 to lock thereof in the gaming pocket 138. The lock clip 142 is twisted 90 degrees to allow removal of the gaming insert 140 from the gaming pocket 138. A pool table surface 146 is preferably formed on the opposite surface of the rotary game table 136, but other game surfaces may also be formed thereupon, such as an air hockey surface.

A plate opening 148 is formed through the gaming plate 137 and a rim opening 150 is formed through the support rim 141 to provide clearance for a dealer chip holder 152. The plate and rim openings provide enough clearance for a dealer to insert their finger therethrough to retrieve chips from the dealer chip holder 152. The dealer chip holder 152 is attached to a side frame member 154 with any suitable attachment method. The dealer chip holder 152 retains a plurality of chips 156. Chip holders are well known in the art and need not be explained in detail. A chip cover 158 is preferably removably attached to a top of the plate opening 148 with any suitable method. A plurality of chip pockets 160 are formed in the gaming plate 137 to receive an individual player's chips.

With reference to FIGS. 20-21, a combination game table 162 includes a table soccer game 164 on one side and a pool table surface 16 on the other side. The table soccer game 164 is preferably regulation size. The combination game table 162 may be substituted for the combination game table 10 in any of the preferred embodiments 1-4. The table soccer game 164 is substituted for the air powered hockey surface 18. The table soccer game 164 includes a game cavity 166, a plurality of moveable rods 168 and two rod retainers. The game cavity 166 is formed below the surface of the combination game table 162. A first rod flange 172 and a second rod flange 174 form the side boundaries of the game cavity 166. The plurality of moveable rods 168 are pivotally and slidably retained by the first and second rod flanges.

A first rod retainer 170 is pivotally attached to one side rail of the combination game table 162 with at least one hinge 176, adjacent the first rod flange 172. The second rod retainer 171 is pivotally attached to an opposing side rail of the combination game table 162 with at least one hinge 176, adjacent the second rod flange 174. The first and second rod retainers reduce the amount of sliding of the plurality of moveable rods 168, when the combination game table 162 is revolved. The first and second rod retainers pivot from a lowered position to a raised position. The first and second rod retainers are locked in a raised position with any suitable locking device, such as a latch. A first side pocket opening 178 is formed through the pool table surface 16, adjacent the one side rail and a second side pocket opening 180 is formed through the pool table surface 16, adjacent the opposing side rail. A ball net 182 is attached to a bottom of each side pocket opening 178, 180 with any suitable method to retain a ball during a game of pool.

With reference to FIGS. 22-23, a combination game table 184 includes a ping-pong surface 186 formed on one side and an air powered hockey surface 18 formed on the other side of thereof. A pair of net retainers 188 are attached to the opposing sides of the combination game table 184 at a middle thereof. A ping-pong net 189 is retained between the pair of net retainers 188. Any play surface such as the pool table surface 16, the air powered hockey surface 18, gaming table 136, the table soccer game 164 or the ping-pong surface 186 may be formed on one side of a combination game table and any other play surface formed on the other side of the combination game table.

With reference to FIGS. 24-25, a fifth embodiment of a rotary game table 5 includes a combination game table 190, two side support members 192, two cross members and two substantially U-shaped side members. The combination game table 190 includes one of the pool table surface 16, air powered hockey surface 18, game table 136, table soccer game 164 and ping-pong surface 186 on one side and one other of the above on the other side. A first cross member 194 and a second cross member 195 each preferably have an "L" shaped cross section. One end of the first cross member 194 and the second cross member 195 are attached to one of the two side support members 192 and the other end of the first and second cross members 194 are attached to the other one of the two side support members 192. A first substantially U-shaped side member 196 and a second substantially U-shaped cross member 197 each include a lengthwise base 198 and two end extensions 200. A single extension 200 extends from each end of the lengthwise base 198. The height "E" of the end extension 200 is at least as high as the height "B" of the lengthwise base 198. A fillet 202 is formed between the inner junction of the extension 200 and the lengthwise base 198. The fillet 202 greatly strengthens the rigidity of the extension 200. However, the fillet 202 may be in the form of a chamfer instead of having a curved shape or may have any other appropriate shape.

The first substantially U-shaped side member 196 is attached to a first end of each side support member 192 and a length of the first cross member 194 with fasteners or the like. A second substantially U-shaped side member 197 is attached to a second end of each side support member and a length of a second cross member 195 with fasteners or the like. The attachment of the first and second cross members and the first and second substantially U-shaped side members to the two side support members 192 has the nonobvious result of not allowing the rotary table 5 to wobble. The combination game table 190 is pivotally retained by the two side support members 192 and rotatably secured by the spring pins 56, locking pins 60, support latches 102 or any other suitable device. The side support members 192 may be configured to retain appropriate accessories.

With reference to FIGS. 26-29, a sixth embodiment of a rotary game table 6 includes a combination game table 204, two side support members 206, two cross members 208 and at least two collapsible supports 210. The combination game table includes one of the pool table surface 16, an air powered hockey surface 18, the game table 136, the table soccer game 164 and the ping-pong surface 186 on one side and one other of the above on the other side. One end of each cross member 208 is attached to one of the two side support members 206 and the other end of each cross member 208 is attached to the other one of the two side support members 206. A pair of support latches 102 are retained in at least one of the two side support members 206. Each support latch 102 includes the support link 108. The combination game table 204 is pivotally retained by the two side support members 206 and rotatably secured by the pair of support latches 102.

A single slide bar 212 is slidably retained within one of the two side support members 206, adjacent each support latch 102. The slide bar 212 includes a slider body 214. The thickness of the slider body 214 is preferably sized to be received by a pair of slider slots 216 formed one each side of a slider pocket 218. A first yoke 220 formed on a first end of the slider body 214 and a second yoke 222 is formed on a second end of the slider body 214. One end of a pusher link 224 is pivotally retained on an end of the support link 108 with a first pivot pin 226 and the other end is pivotally retained in the first yoke 220 with a second pivot pin 228 on the slide bar 212. Each collapsible support 210 preferably includes a first locking arm 230 and a second locking arm 232. One end of the first locking arm 230 is pivotally retained in the second yoke 222 with a third pivot pin 234. The other end of the first locking arm 230 is pivotally attached to one end of the second locking arm 232

A locking projection 236 is formed on the other end of the first locking arm 230 and a locking hook 238 is formed on an end of the second locking arm 232 to receive the locking projection 236. The combination of the locking projection 236 and the locking hook 238 improve the rigidity of the collapsible support 210 in a locking position. However, other methods of locking the first and second locking arms may also be used. The other end of the second locking arm 232 is pivotally retained by the cross member 208 with a fourth pivot pin 240. The collapsible support 210 locks in place, when the support latch 102 is locked. The at least two collapsible supports 210 increase the rigidity of the rotary game table 6. The side support members 206 may be configured to retain appropriate accessories.

With reference to FIGS. 30-32, a method for improving the rigidity of a connection between the side support member 92, 206 to cross member 94, 208 preferably includes at least eight threaded fasteners 242 and at least eight traversely tapped cylinders 244. However, only one end of each cross member 94 may include the at least two traversely tapped cylinders 244. At least two fastener holes 245 are formed through a front of the side support member at each end thereof. At least two cylinder holes 246 are formed through the side of a single cross member 94, 208 at an end thereof. Each cylinder hole 246 is sized to receive a single traversely tapped cylinder 244. Each traversely tapped cylinder 244 preferably includes a traversely tapped hole 248, a retention portion 250 and a turning cavity 252. The single cross member 94, 208 is shown as having a tubular cross section, but may also have a solid cross section.

The tapped hole 248 formed traversely through the traversely tapped cylinder 244 relative to an axis thereof. The retention portion 250 is formed on one end of the traversely tapped cylinder 244 to prevent axial movement in one of both directions. The turning cavity 252 preferably has a hex shape, but other shapes may also be used, such as a rectangular slot. A turning projection (not shown) would extend outward from the retention portion 250. The turning projection would replace the turning cavity 252. The turning projection would preferably also have a hex shape, but other shapes may also be used. The end of the cross member 94, 208 is retained against the side support member 92, 206 by tightening the at least two threaded fasteners 242 in the traversely tapped holes 248.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A rotary game table comprising:

a combination game table including an air hockey game surface defining a first plane and a second game surface defining a second plane;

two spaced apart side supports rotatably supporting the combination game table; and a blower positioned between the first plane and the second plane, the blower supplying air to the air hockey game surface;

wherein one of the two side supports includes a first outer surface and the other of the two side supports includes a second outer surface, and wherein the blower is positioned between the first outer surface and the second outer surface; and wherein the combination game table defines a cavity between the air hockey game surface and the second game surface, and wherein the blower is positioned in the cavity.

2. The rotary game table of claim 1, wherein the combination game table further includes a drawer, the blower being supported in the drawer to position the blower in the cavity.

3. The rotary game table of claim 2, wherein the combination game table further includes a frame supporting the air hockey game surface and the second game surface, the frame defining an air vent in fluid communication with the blower to provide air to the air hockey game surface.

4. The rotary game table of claim 1, further comprising a pair of latches, each latch including a housing connected to one side support, a lever pivotably supported by the housing, and a projection extending from the lever, the projection being moved by the lever between a locked position, in which the projection engages the combination game table to prevent rotation of the combination game table, and an unlocked position, in which the projection is disengaged from the combination game table;

wherein the combination game table defines a rotation axis about which the combination game table rotates, the rotation axis being between the pair of latches.

5. The rotary game table of claim 1, wherein the combination game table further includes a diffuser plate spaced from the air hockey surface to define an air gap, and the diffuser plate defining an air hole through which the air gap is in fluid communication with the blower, and wherein the air hockey surface defines a plurality of holes therethrough, in operation, the blower causing air flow from the blower through the air hole to the air gap and from the air gap through the holes.

6. The rotary game table of claim 1, further comprising:

a pivot pin connected between the combination game table and one of the side supports, the pivot pin defining a rotation axis about which the combination game table rotates; and a power cord connected to the blower and operable to connect the blower to a power source, the power cord extending through the pivot pin.

7. A rotary game table comprising:

a combination game table including an air hockey game surface defining a first plane and a second game surface defining a second plane;

two spaced apart side supports rotatably supporting the combination game table; and a blower positioned between the first plane and the second plane, the blower supplying air to the air hockey game surface;

wherein the combination game table further includes a diffuser plate spaced from the air hockey surface to define an air gap, and the diffuser plate defining an air hole through which the air gap is in fluid communication with the blower, and wherein the air hockey surface defines a plurality of holes therethrough, in operation, the blower causing air flow from the blower through the air hole to the air gap and from the air gap through the holes; and wherein the combination game table further includes a cross member in contact with the diffuser plate, the cross member defining a hole, in operation, the blower causing air flow through the hole of the cross member.

8. The rotary game table of claim 7 further comprising a pair of latches, each latch including a housing connected to one side support, a lever pivotably supported by the housing, and a projection extending from the lever, the projection being moved by the lever between a locked position, in which the projection engages the combination game table to prevent rotation of the combination game table, and an unlocked position, in which the projection is disengaged from the combination game table;

wherein the combination game table defines a rotation axis about which the combination game table rotates, the rotation axis being between the pair of latches.

9. The rotary game table of claim 7, further comprising:

a pivot pin connected between the combination game table and one of the side supports, the pivot pin defining a rotation axis about which the combination game table rotates; and a power cord connected to the blower and operable to connect the blower to a power source, the power cord extending through the pivot pin.

10. A rotary game table comprising:

a combination game table including an air hockey game surface defining a plurality of holes therethrough and a second game surface, the combination game table also including a diffuser plate positioned between the air hockey game surface and the second game surface and spaced from the air hockey surface to define an air gap, the diffuser plate defining an air hole:

two spaced apart side supports rotatably supporting the combination game table; and a blower supported to cause air flow through the air hole to the air gap and from the air gap through the holes;

wherein the combination game table defines a cavity between the air hockey game surface and the second game surface, and wherein the blower is positioned in the cavity.

11. The rotary game table of claim 10, wherein the combination game table further includes a frame supporting the air hockey game surface and the second game surface, the frame defining an air vent in fluid communication with the blower to provide air to the air hockey game surface.

12. The rotary game table of claim 10, further comprising a pair of latches, each latch including a housing connected to the first side support, a lever pivotably supported by the housing, and a projection extending from the lever, the projection being moved by the lever between a locked position, in which the projection engages the combination game table to prevent rotation of the combination game table, and an unlocked position, in which the projection is disengaged from the combination game table;

wherein the combination game table defines a rotation axis about which the combination game table rotates, the rotation axis being between the pair of latches.

13. The rotary game table of claim 10, further comprising:

a pivot pin connected between the combination game table and one of the side supports, the pivot pin defining a rotation axis about which the combination game table rotates; and a power cord connected to the blower and operable to connect the blower to a power source, the power cord extending through the pivot pin.

14. A rotary game table comprising:

a combination game table including an air hockey game surface defining a plurality of holes therethrough and a second game surface, the combination game table also including a diffuser plate positioned between the air hockey game surface and the second game surface and spaced from the air hockey surface to define an air gap, the diffuser plate defining an air hole:

two spaced apart side supports rotatably supporting the combination game table; and a blower supported to cause air flow through the air hole to the air gap and from the air gap through the holes;

wherein the combination game table further includes a cross member in contact with the diffuser plate, the cross member defining a hole, in operation, the blower causing air flow through the hole of the cross member.

15. The rotary game table of claim 14, wherein the combination game table further includes a frame supporting the air hockey game surface and the second game surface, the frame defining an air vent in fluid communication with the blower to provide air to the air hockey game surface.

16. The rotary game table of claim 14, further comprising a pair of latches, each latch including a housing connected to the first side support, a lever pivotably supported by the housing, and a projection extending from the lever, the projection being moved by the lever between a locked position, in which the projection engages the combination game table to prevent rotation of the combination game table, and an unlocked position, in which the projection is disengaged from the combination game table;

wherein the combination game table defines a rotation axis about which the combination game table rotates, the rotation axis being between the pair of latches.

17. The rotary game table of claim 14, further comprising:

a pivot pin connected between the combination game table and one of the side supports, the pivot pin defining a rotation axis about which the combination game table rotates; and a power cord connected to the blower and operable to connect the blower to a power source, the power cord extending through the pivot pin.

18. A method of operating a rotary game table, the method comprising:

providing a rotary game table including a combination game table including an air hockey game surface defining a plurality of holes, a second game surface, and a diffuser plate positioned between the hockey game surface and the second game surface, the diffuser plate being spaced from the air hockey game surface to form an air gap and defining an air hole, two side supports rotatably supporting the combination game table, and a blower in fluid communication with the air gap through the air hole; and operating the blower to supply air through the air hole to the air gap and from the air gap through the holes;

wherein providing the combination game table includes providing a cross member in contact with the diffuser plate, the cross member defining a hole, and wherein operating the blower includes operating the blower to supply air through the hole of the cross member to the air gap.

19. The method of claim 18, wherein providing the combination game table includes defining a cavity between the air hockey game surface and the second game surface, and positioning the blower in the cavity.

20. A method of operating a rotary game table, the method comprising:

providing a rotary game table including a combination game table including an air hockey game surface defining a plurality of holes, a second game surface, and a diffuser plate positioned between the hockey game surface and the second game surface, the diffuser plate being spaced from the air hockey game surface to form an air gap and defining an air hole, two side supports rotatably supporting the combination game table, and a blower in fluid communication with the air gap through the air hole; and operating the blower to supply air through the air hole to the air gap and from the air gap through the holes;

wherein providing the combination game table includes defining a cavity between the air hockey game surface and the second game surface, and positioning the blower in the cavity.

* * * * *